US010680384B2

(12) United States Patent
Tsai

(10) Patent No.: US 10,680,384 B2
(45) Date of Patent: Jun. 9, 2020

(54) BIDIRECTIONAL DUPLEX ELECTRICAL CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 16/071,613

(22) PCT Filed: Jan. 23, 2017

(86) PCT No.: PCT/CN2017/072259
§ 371 (c)(1),
(2) Date: Jul. 20, 2018

(87) PCT Pub. No.: WO2017/125091
PCT Pub. Date: Jul. 27, 2017

(65) Prior Publication Data

US 2019/0027868 A1 Jan. 24, 2019

Related U.S. Application Data

(60) Provisional application No. 62/281,756, filed on Jan. 22, 2016.

(51) Int. Cl.

| | |
|---|---|
| ***H01R 13/64*** | (2006.01) |
| ***H01R 13/642*** | (2006.01) |
| ***H01R 13/6585*** | (2011.01) |
| ***H01R 13/11*** | (2006.01) |
| ***H01R 13/405*** | (2006.01) |
| ***H01R 24/60*** | (2011.01) |
| *H01R 107/00* | (2006.01) |
| *H01R 43/20* | (2006.01) |

(Continued)

(52) U.S. Cl.
CPC ..... *H01R 13/642* (2013.01); *H01R 13/112* (2013.01); *H01R 13/405* (2013.01); *H01R 13/6585* (2013.01); *H01R 24/60* (2013.01); *H01R 13/6586* (2013.01); *H01R 43/16* (2013.01); *H01R 43/20* (2013.01); *H01R 2107/00* (2013.01)

(58) Field of Classification Search
CPC ... H01R 13/642; H01R 13/112; H01R 13/405
USPC ..... 439/218
See application file for complete search history.

(56) References Cited

U.S. PATENT DOCUMENTS 7,095,617 B1 * 8/2006 Ni ..... H05K 5/0278 361/736
9,142,926 B2 * 9/2015 Tsai ..... H01R 24/60

(Continued)

*Primary Examiner* — Alexander Gilman
(74) *Attorney, Agent, or Firm* — WPAT, PC

(57) ABSTRACT

A bidirectional duplex electrical connector includes: two insulation seats; two rows of terminals assembled into the two rows of terminal slots of the two insulation seats in a vertical direction, wherein the terminal is integrally provided with, from front to rear, an elastically movable portion, a fixing portion and a pin, a front section of the elastically movable portion is curved and provided with a projecting contact, the elastically movable portion is vertically elastically movable, a rear section of the elastically movable portion and the fixing portion are on the same level and rest against a bottom surface of the terminal slot, a depth of the terminal slot is greater than a material thickness of the terminal, and the insulation seat is provided with a fixing structure fixing the fixing portions of the one row of terminals; and a metal housing covering the two insulation seats.

16 Claims, 23 Drawing Sheets

(51) Int. Cl.
*H01R 43/16* (2006.01)
*H01R 13/6586* (2011.01)

(56) References Cited

U.S. PATENT DOCUMENTS

| | | | | |
|---|---|---|---|---|
| 9,577,360 | B2 * | 2/2017 | Kao | H01R 12/722 |
| 9,853,398 | B2 * | 12/2017 | Tsai | H01R 24/62 |
| 10,158,190 | B1 * | 12/2018 | Sun | H01R 24/60 |
| 2016/0064879 | A1 * | 3/2016 | Yen | H01R 24/78 439/607.01 |
| 2016/0156144 | A1 * | 6/2016 | Kao | H01R 24/60 439/676 |
| 2016/0204540 | A1 * | 7/2016 | Chen | H01R 13/56 439/660 |
| 2017/0194754 | A1 * | 7/2017 | Tsai | H01R 13/502 |
| 2017/0214193 | A1 * | 7/2017 | Tsai | H01R 13/502 |
| 2017/0222371 | A1 * | 8/2017 | Zhang | H01R 13/655 |
| 2017/0279226 | A1 * | 9/2017 | Tsai | H01R 13/502 |
| 2017/0352990 | A1 * | 12/2017 | Zhao | H01R 13/6591 |
| 2018/0175529 | A1 * | 6/2018 | Wang | H01R 12/721 |
| 2018/0198248 | A1 * | 7/2018 | Sun | G06F 1/1632 |
| 2018/0212337 | A1 * | 7/2018 | Chang | H01R 13/6586 |
| 2018/0294604 | A1 * | 10/2018 | Chien | H01R 13/514 |
| 2018/0351282 | A1 * | 12/2018 | Duan | H01R 13/6585 |
| 2019/0027868 | A1 * | 1/2019 | Tsai | H01R 13/6585 |

* cited by examiner

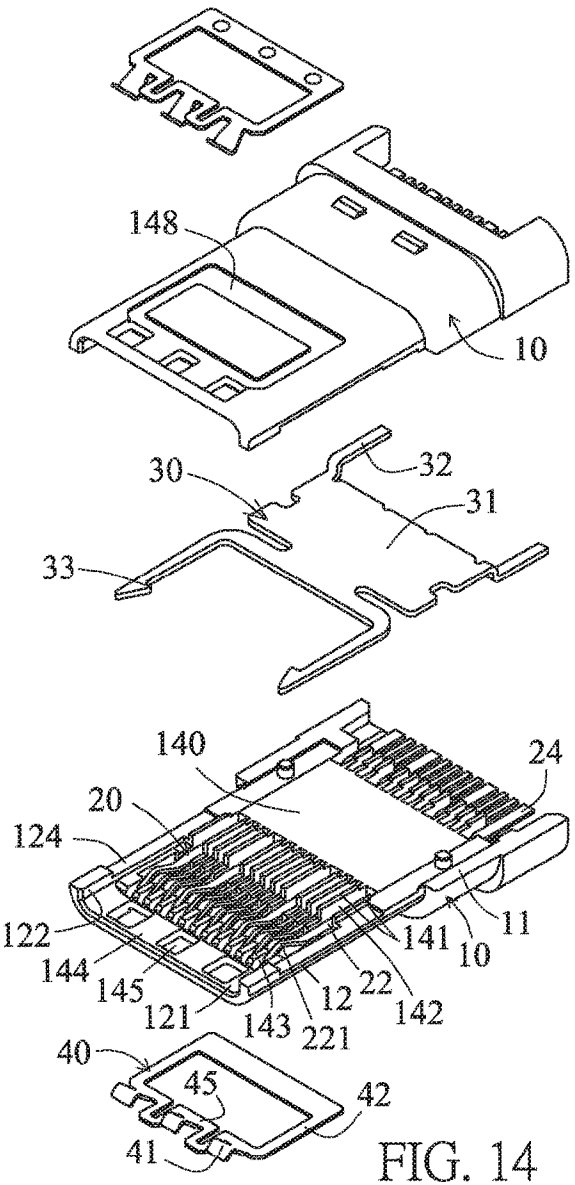
FIG. 14
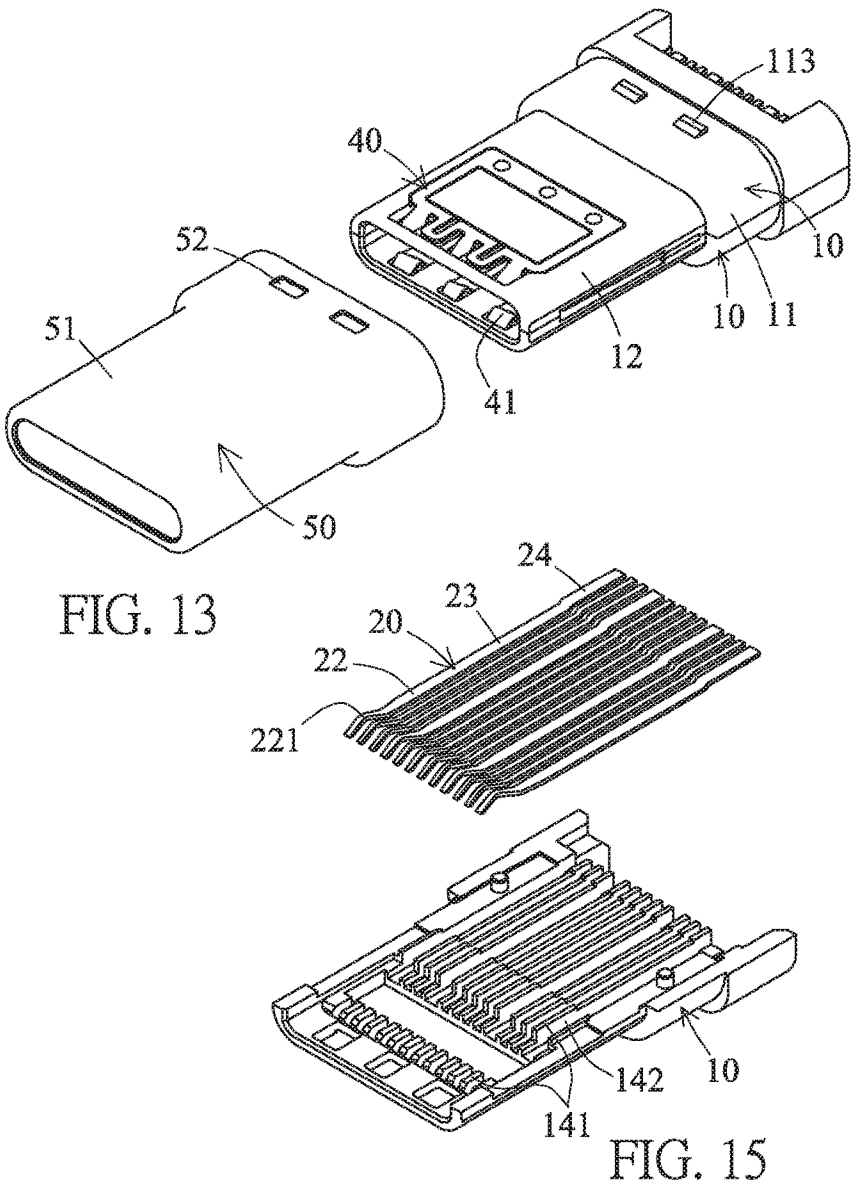
FIG. 13
FIG. 15

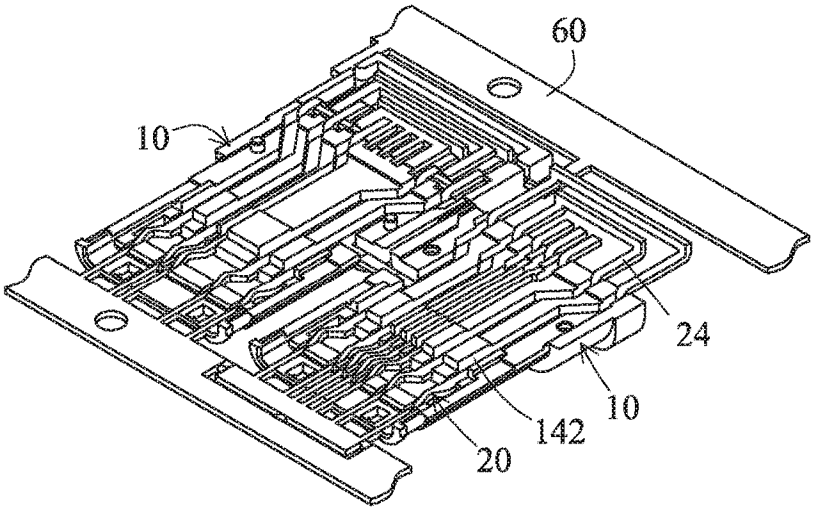
FIG. 27
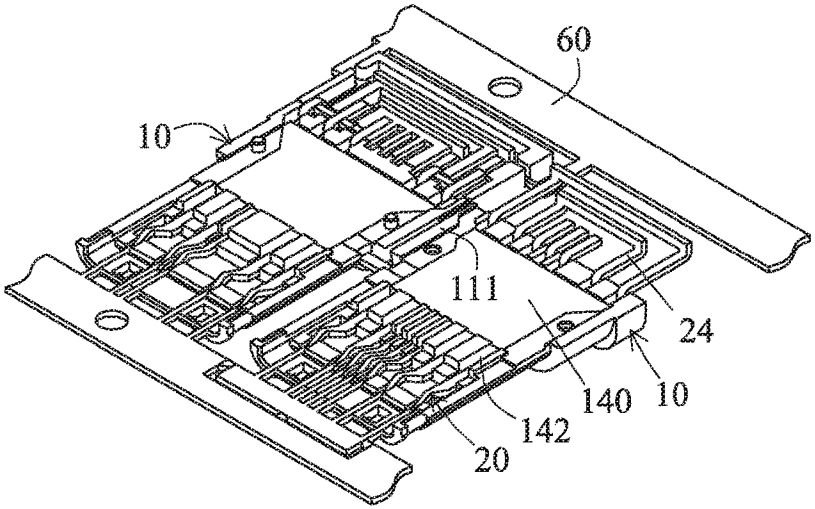
FIG. 28
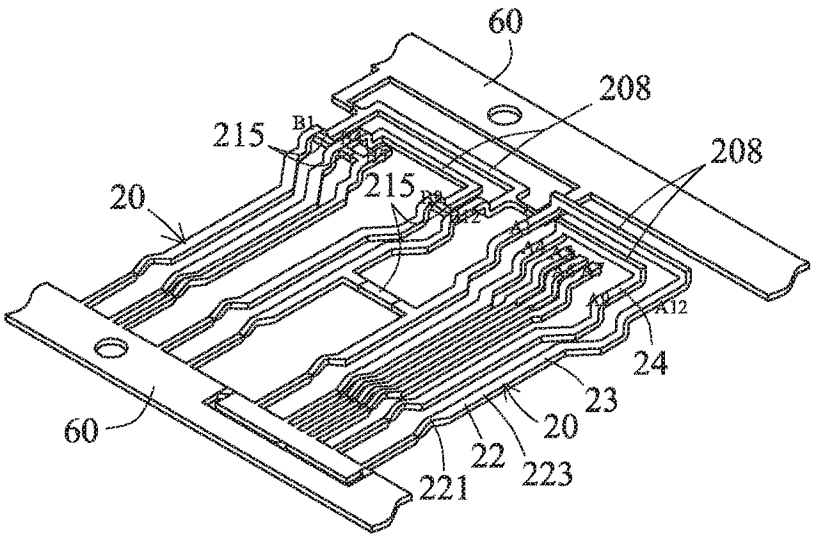
FIG. 26
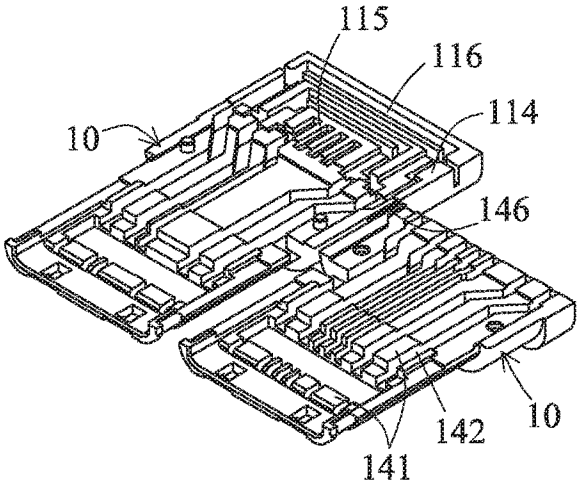

BIDIRECTIONAL DUPLEX ELECTRICAL CONNECTOR

CROSS-REFERENCE TO RELATED APPLICATIONS

This application is a national stage application of PCT Patent Application No. PCT/CN2017/072259, filed on Jan. 23, 2017, which claims priority to U.S. Provisional Application No. 62/281,756, filed on Jan. 22, 2016, the content of which is incorporated herein by reference. This application is also a continuation-in-part of and claims the benefit of priority from co-pending U.S. patent application Ser. No. 16/166,433, filed Oct. 22, 2018, which is a Divisional Application of and claims the benefit of priority from U.S. patent application Ser. No. 15/321,373, filed Dec. 22, 2016, now U.S. Pat. No. 10,109,966, the full disclosures of which are incorporated herein by reference.

BACKGROUND OF THE INVENTION

Field of the Invention

The invention relates to an electrical connector, and more particularly to a bidirectional duplex electrical connector.

Description of the Related Art

At present, because the functions of various electronic products are becoming more and more powerful and handheld devices are also becoming more and more popular, the demands for signal transmission between various products or devices are increasing, wherein the signal transmission between these devices are conducted through signal interfaces. The signal interface may be, for example, an electrical connector or a complementary electrical connector docking therewith. The electrical connector is an electrical receptacle, and the complementary electrical connector is an electrical plug.

Before docking between the electrical plug and the electrical receptacle, the electrical plug needs to face the electrical receptacle in a correct direction so that the docking can be performed. That is, the electrical receptacle has the inserting connection orientation, which is the so-called mistake-proof function. This function is to ensure the connection interface on the electrical plug to contact the contact terminal on the electrical receptacle. However, most users do not have the habit of placing the electrical plug to face the electrical receptacle in the correct direction, and this mistake-proof function causes docking failure between the electrical plug and the electrical receptacle. Then, the user flips the electrical plug to perform the correct docking. In other words, this mistake-proof function brings troubles to the user on the contrary.

Therefore, a bidirectional electrical connector having a duplex docking function is available on the market and is provided with two sets of contact terminals to eliminate the inserting connection orientation of the bidirectional electrical connector. The user can dock the bidirectional electrical connector with the complementary electrical connector in either direction. However, the conventional bidirectional electrical connector has the high manufacturing cost, and the low reliability of the function. Based on this, how to make the bidirectional electrical connector have the stable reliability and decrease the cost of the electrical connector becomes the goal of the common efforts of the industries.

BRIEF SUMMARY OF THE INVENTION

A main object of the invention is to provide a bidirectional duplex electrical connector, wherein the manufacturing and assembling costs can be decreased, and the duplex docking function can be provided.

To achieve the above-identified object, the invention provides a bidirectional duplex electrical connector, including: two insulation seats, wherein each of the insulation seats is integrally provided with a base portion and a docking portion, the docking portion is connected to a front end of the base portion, the docking portion is provided with a baseplate and two side plates, multiple inner surfaces of the base portions of the two insulation seats are provided with multiple resting surfaces mutually resting against each other and being vertically stacked, a connection slot is formed between the baseplates of the docking portions of the two insulation seats, a front section of the baseplate is provided with a low surface and a rear section of the baseplate is provided with a high surface, the two side plates of the docking portions of the two insulation seats mutually rest against each other to form a fitting frame body, each of the inner surfaces of the two insulation seats is provided with one row of separation columns performing separation to form one row of front-to-rear extending terminal slots, and the terminal slots extend from the base portion to the docking portion; two rows of terminals, wherein the two rows of terminals are assembled into the two rows of terminal slots of the two insulation seats in a vertical direction, the terminal is integrally provided with, from front to rear, an elastically movable portion, a fixing portion and a pin, a front section of the elastically movable portion corresponds to the docking portion and is curved and provided with a contact projecting beyond the high surface in the vertical direction, the elastically movable portion is vertically elastically movable, a rear section of the elastically movable portion and the fixing portion are on the same level and rest against a bottom surface of the terminal slot, a depth of the terminal slot is greater than a material thickness of the terminal, so that the rear section of the elastically movable portion and the fixing portion fall into the terminal slot, the insulation seat is provided with a fixing structure fixing the fixing portions of the one row of terminals, the rear sections of the elastically movable portions of the one row of terminals still can rest against the bottom surfaces of the terminal slots to perform vertical elastic movement, the pin extends to a rear end of the base portion and is exposed, and the contacts of the two rows of terminals having connection points with the same circuit serial numbers are arranged reversely; and a metal housing, which covers the two insulation seats and is provided with a four-sided main housing, wherein the four-sided main housing covers the docking portions of the two insulation seats to form a docking structure, and the docking structure can be positioned with a docking electrical connector in a dual-positional and bidirectional manner.

Because the rear sections and the fixing portions of the elastically movable portions of the two rows of terminals have the same level and rest against the bottom surfaces of the terminal slots, easy assembling can be achieved and stamping can be simplified, and the manufacturing cost can be decreased. In addition, the rear section of the elastically movable portion of the terminal horizontally rests against the bottom surface of the terminal slot, the support effect of the middle section of the elastic arm can be obtained, thereby increasing the normal force of contacting the terminal and the resilience.

The above-mentioned and other objects, advantages and features of the invention may become more apparent from the following detailed description of the preferred embodiments with reference to the accompanying drawings.

BRIEF DESCRIPTION OF THE SEVERAL VIEWS OF THE DRAWINGS

FIG. 13 is a pictorially exploded view showing the first modification implementation according to the first embodiment of the invention.

FIG. 14 is a pictorially exploded view showing the first modification implementation according to the first embodiment of the invention.

FIG. 15 is a pictorially exploded view showing the first modification implementation according to the first embodiment of the invention.

FIG. 26 is a pictorial view showing the manufacturing process according to the second embodiment of the invention.

FIG. 27 is a pictorial view showing the manufacturing process according to the second embodiment of the invention.

FIG. 28 is a pictorial view showing the manufacturing process according to the second embodiment of the invention.

DETAILED DESCRIPTION OF THE INVENTION

Figure 1:
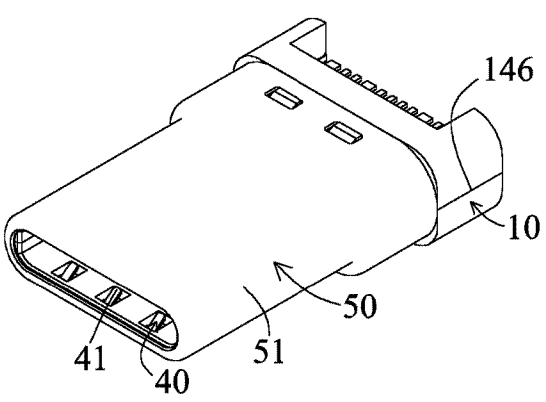
FIG. 1 is a pictorial view showing the first embodiment of the invention.

Referring to FIGS. 1 to 7 a bidirectional duplex USB TYPE-C 3.0 electrical plug according to the first embodiment of the invention includes two insulation seats 10, two rows of terminals 20, a metal partition plate 30, two ground members 40 and a metal housing 50.

The insulation seat 10 is integrally provided with a base portion 11 and a docking portion 12. The docking portion 12 is connected to the front end of the base portion 11. The inner surfaces of the base portions 11 of the two insulation seats are provided with connection surfaces 111 resting against each other. One of the insulation seats is provided with an engagement hole 151 engaging with an engagement column 152 of the other insulation seat. The rear section of the base portion 11 is higher than the front section thereof and the outer surface of the rear section is provided with an engagement block 113. The docking portion 12 is provided with a baseplate 121 and two side plates 122. The two side plates 122 are connected to left and right sides of the baseplate 121. The front section of the inner surface of the baseplate 12 is provided with a low surface 144, and the rear section of the inner surface of the baseplate 12 is provided with a high surface 143. The low surface 144 is provided with three through holes 145. The inner surface of the insulation seat 10 is provided with one row of separation columns 141 performing separation to form one row of front-to-rear extending terminal slots 142. The terminal slot 142 extends from the base portion 11 to the docking portion 12, and the terminal can be placed into the terminal slot in the vertical direction. The front section of the outer surface of the baseplate 12 is provided with a concave surface 148, and the portions corresponding to the front of the three through holes 145 are provided with three more concave surfaces 147, which are more concave than the three concave surfaces 148. First sides of the base portions of the two insulation seats 20 are respectively integrally provided with two plastic material bridges 146 mutually connected together. When one insulation seat 20 is flipped by 180 degrees, the two insulation seats 20 are vertically stacked, the connection surfaces 111 of the base portions of the two insulation seats rest against each other, the front sections of the two side plates 122 of the docking portions 12 of the two insulation seats are higher and connected together, and the middle section thereof is lower and formed with an opening 124. A connection slot 125 is formed between the inner surfaces of the baseplates 121 of the two insulation seats.

Figure 55:
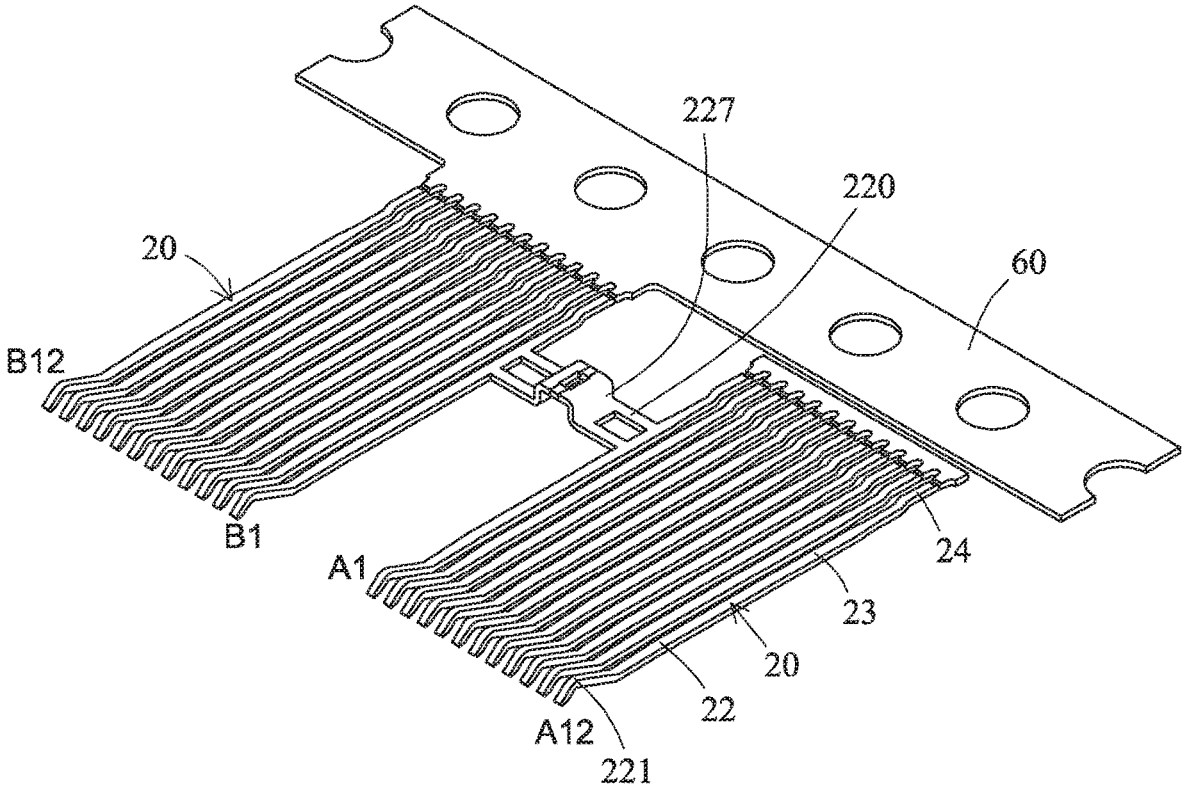
FIG. 55 is a pictorial view showing the manufacturing process according to the fifth embodiment of the invention.

The two rows of terminals 20 are assembled into the two rows of terminal slots 142 of the two insulation seats 10 in the vertical direction, and each of the rows of terminals 20 have 12 terminals, as shown in FIG. 55, wherein the upper row of terminals are represented by A, the connection points with the circuit serial numbers arranged from right to left as A1, A2, A3, . . . , and A12 in order, the lower row of terminals are represented by B, and the connection points with the circuit serial numbers arranged from right to left as B12, B11, B10, . . . , B1 in order. Each terminal 20 is integrally provided with an elastically movable portion 22, a fixing portion 23 and a pin 24 from front to rear, the front section of the elastically movable portion 22 corresponds to the depression area 123 of the docking portion, and is curved and provided with a contact 221 projecting beyond the high surface 143 in the vertical direction. The elastically movable portion 22 is vertically elastically movable, the rear section 223 of the elastically movable portion and the fixing portion 23 are on the same level and resting against the bottom surface of the terminal slot 142. The depth of the terminal slot 142 is greater than the material thickness of the terminal, so that the rear section 223 of the elastically movable portion and the fixing portion 23 fall into the terminal slot 142. Then, a fixing structure 140 is formed at the position corresponding to the fixing portion 23 by way of secondary processing and encapsulant. The fixing structure 140 covers the fixing portions 23 of the one row of terminals 20 and has a plane slightly depressed from the connection surface 111. The pin 24 horizontally extends out of the rear end of the base portion. In addition, the front end of the front fixing portion 21 has an electroplate-free layer 25 exposing from the front end of the insulation seat 10. The contacts 221 of the two rows of terminals are arranged according to the circuit serial number of the connection point and are arranged in an equally spaced manner, and two rows of contacts have the connection points with the same circuit serial numbers are arranged reversely.

The connection points with the circuit serial numbers according to the USB TYPE-C specified by USB Association will be explained in the following: 1 and 12 are one pair of ground terminals arranged in a left-right symmetrical manner; 4 and 9 are one pair of power terminals arranged in a left-right symmetrical manner; 2 and 3 are one pair of high differential signal terminals (TX+,TX−); 10 and 11 are the other one pair of high differential signal terminals (RX+, RX−); 6 and 7 are one pair of low differential signal terminals (D+,D−); 5 and 8 are detection terminals, wherein the ground terminal and the power terminal have the requirement of transmitting the high current, and the other terminals do not have the requirement of transmitting the high current. In the design of this embodiment, the plate widths from the rear section 223 of the elastically movable portion to the pin 24 of A1, A4, A9, A12, B1, B4, B9 and B12 of the two rows of terminals are wider than other terminals.

The metal partition plate 30 is disposed between the two insulation seats 10 and connected to the fixing portion 40. The metal partition plate 30 is provided with a main plate surface 31. Each of left and right sides of the main plate surface 31 extends frontwards and is integrally provided with a resilient snap 33, and extends backwards and is integrally provided with a horizontal pin 32. The resilient snap 33 can correspond to the opening 124 to elastically move in the left-right direction.

The two ground members 40 are respectively connected to and positioned at the outer surfaces of the baseplate 121 of the docking portions 12 of the two insulation seats 10, the ground member 40 provided with a positioning sheet 42 and a twisting sheet 45. The twisting sheet 45 is disposed at the middle of the positioning sheet and is curve-shaped to form a continuous U-shape in the front-to-rear direction. The twisting sheet 45 is integrally connected to and provided with three elastic sheets 41. The three elastic sheets 41 are vertically elastically movable, and each of two of the elastic sheets 41 is formed with a U-shaped sheet body. The positioning sheet 42 and the twisting sheet 45 of the ground member 40 are placed on the concave surface 148 of the outer surface of the baseplate 121. The three elastic sheets 41 pass through the three through holes 145 and project beyond the low surface 144.

The metal housing 50 is formed by metal pulling and extending and covers the two insulation seats 10 and rests against the two ground members 40. The metal housing 50 is provided with a four-sided main housing 51 and a positioning portion 52. The four-sided main housing 51 covers the docking portions 12 of the two insulation seats 10 to form a docking structure. The docking structure can be positioned with a docking electrical connector in a dual-positional and bidirectional manner. The positioning portion 52 is higher than the four-sided main housing 51 and is provided with an engagement hole 53 engaging with the engagement block 113.

The method of manufacturing this embodiment will be described in the following.

Figure 8:
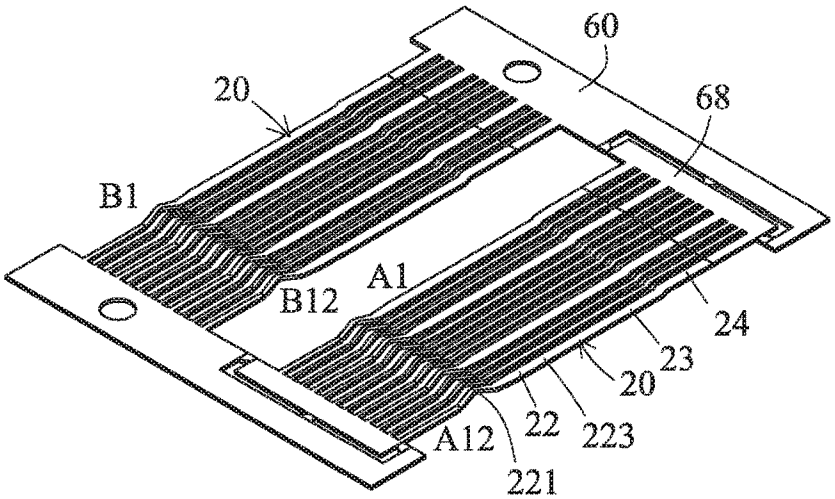
FIG. 8 is a pictorial view showing the manufacturing process according to the first embodiment of the invention.
Figure 8:
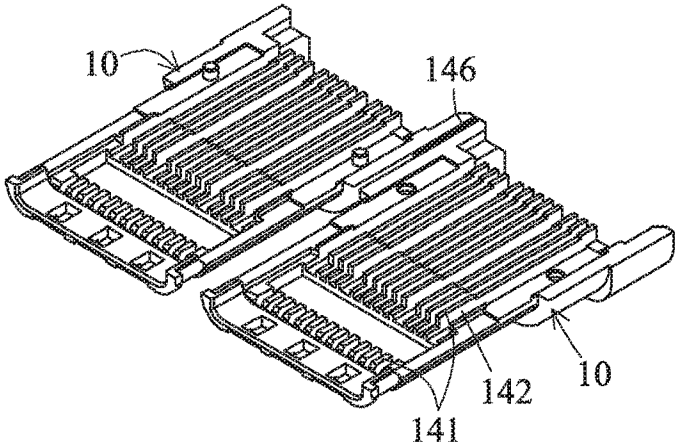

Referring to FIG. 8, the two rows of terminals 20 are provided. The two rows of terminals 20 are formed by stamping the same metal sheet and are arranged adjacently and have two ends connected to a material tape 60. The material tape 60 is provided with a sub-material tape 68 connected to the upper row of terminals. The two rows of terminals 20 have the connection points with the same circuit serial numbers arranged sequentially and in the same direction. In addition, the two insulation seats 10 are provided. The two insulation seats 10 are integrally plastic injection molded. One side of the base portion 11 of each of the two insulation seats 20 is integrally provided with a plastic material bridge 146, and the plastic material bridges 146 are mutually connected together.

Figure 9:
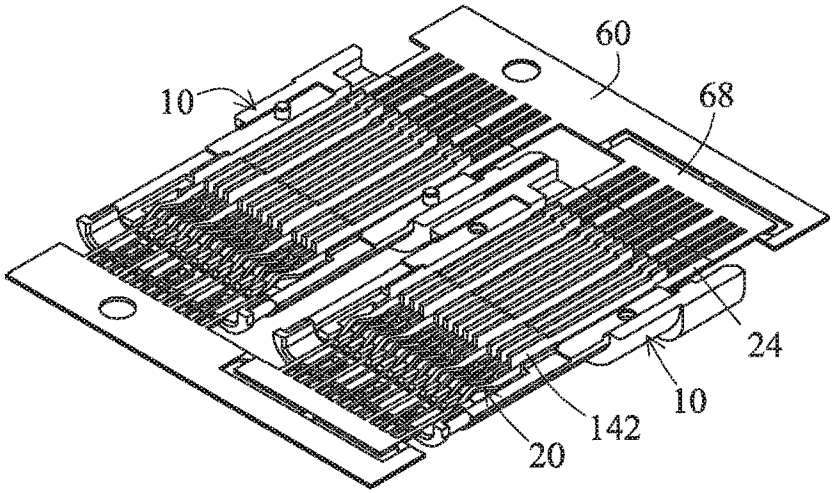
FIG. 9 is a pictorial view showing the manufacturing process according to the first embodiment of the invention.

Referring to FIG. 9, the two rows of terminals 20 are then assembled into the two rows of terminal slots 142 of the two insulation seats 10 in the vertical direction. The rear sections 223 of the elastically movable portions and the fixing portions 23 of the two rows of terminals 20 are on the same level and rest against the bottom surfaces of the two rows of terminal slots 142 of the two insulation seats 10. The depth of the terminal slot 142 is greater than the material thickness of the terminal 20, so that the rear section 223 of the elastically movable portion and the fixing portion 23 fall into the terminal slot 142.

Figure 10:
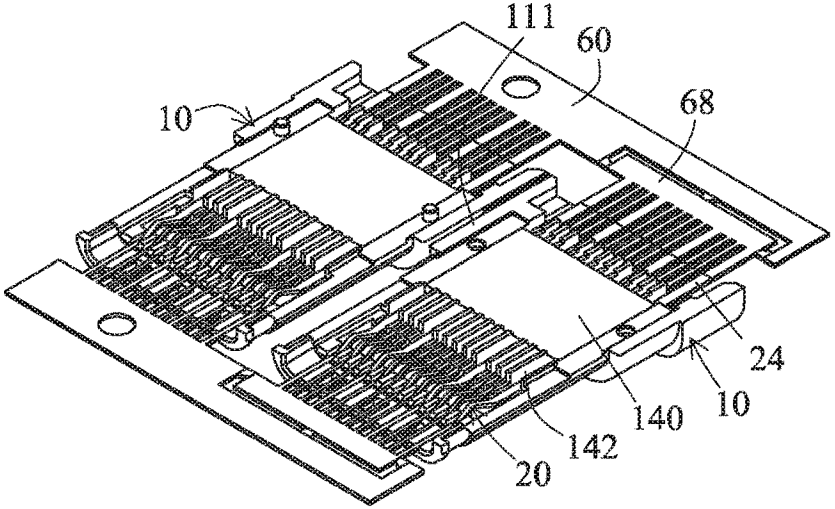
FIG. 10 is a pictorial view showing the manufacturing process according to the first embodiment of the invention.

Referring to FIG. 10, the encapsulant is then provided at the position corresponding to the fixing portion 23 by way of secondary processing to form the fixing structure 140, wherein the fixing portion 140 covers the fixing portions 23 of the one row of terminals 20 and is in the form of a plane slightly depressed from the connection surface 111.

Figure 11:
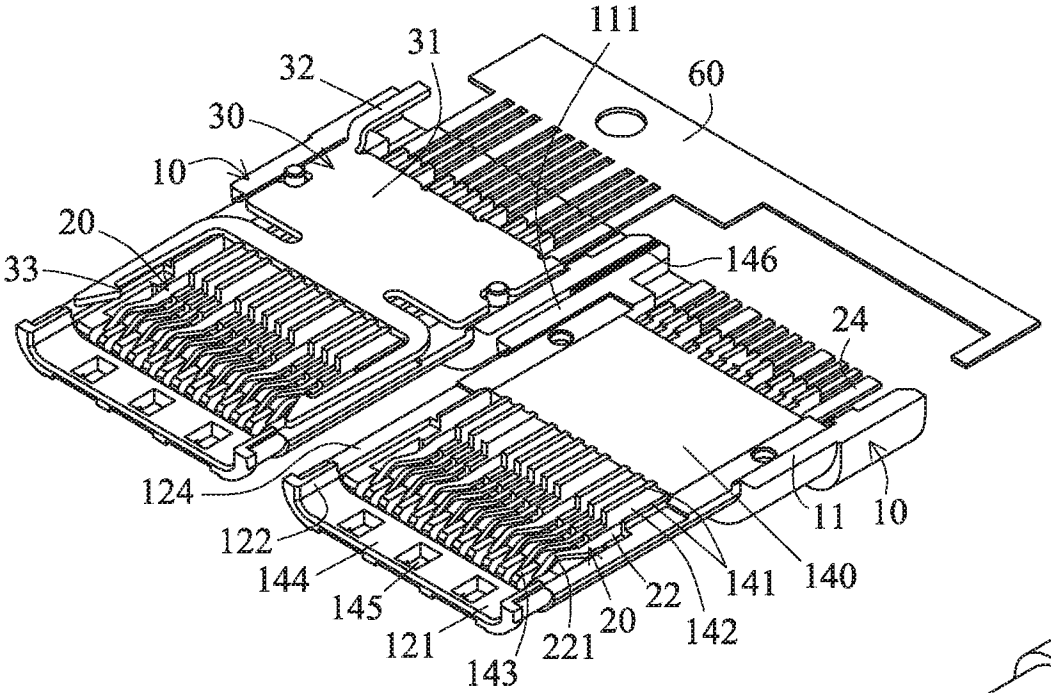
FIG. 11 is a pictorial view showing the manufacturing process according to the first embodiment of the invention.

Referring to FIG. 11, the metal partition plate 30 is then provided and placed on the fixing portion 140 of one insulation seat 10. At this time, the material tape 60 on the front ends of the two rows of terminals is cut off, and then the sub-material tape on the rear ends of one row of terminals 20 on the other insulation seat 10 is cut off.

Figure 12:
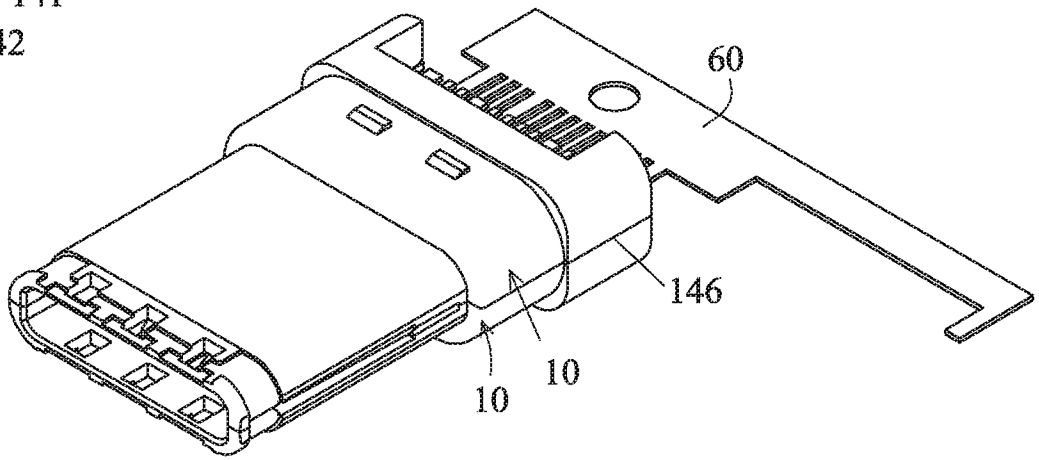
FIG. 12 is a pictorial view showing the manufacturing process according to the first embodiment of the invention.

Referring to FIG. 12, the insulation seat 20 is then separated from the material tape flipped by 180 degrees and stacked over the other insulation seat 20, and the two insulation seats 20 are vertically stacked. At this time, two rows of terminals 20 having the connection points with the same circuit serial numbers are arranged reversely in order.

Then, the two ground members 40 are assembled onto the outer surfaces of the docking portions 12 of the two insulation seats 10, and finally the metal housing 50 is assembled, from front to rear, to cover and be fixed to the two insulation seats 10.

Furthermore, the fixing structures of the two insulation seats 20 for fixing the terminals 20 may also lock the terminals by hot melting the separation columns between the terminal slot 142, or the terminal slot 142 is provided with the slot structure. When the terminal is placed into the terminal slot in the vertical direction and then shifted in a front-rear direction, the slot structure can lock the fixing portion of the terminal.

According to the structural explanation, the invention has the following advantages.

Figure 2A:
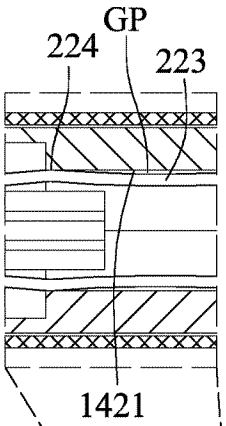
FIG. 2A shows the used state according to the first embodiment of the invention.
Figure 2A:
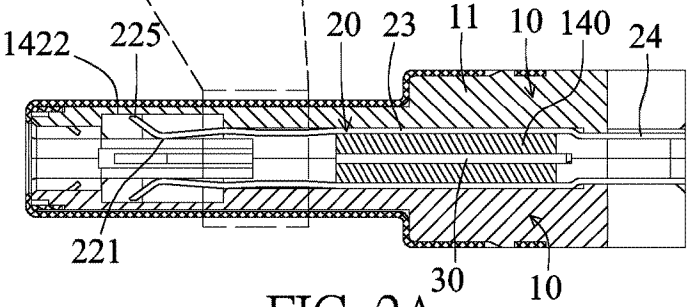
Figure 2:
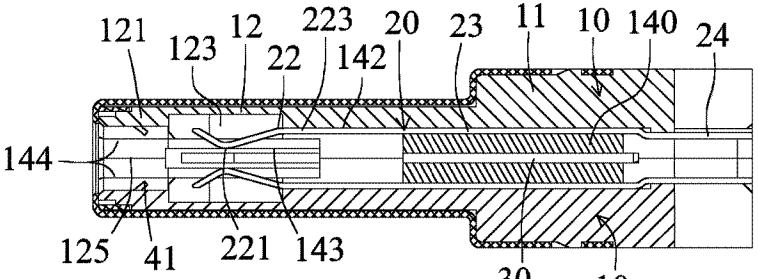
FIG. 2 is a cross-sectional side view showing the first embodiment of the invention.
Figure 4:
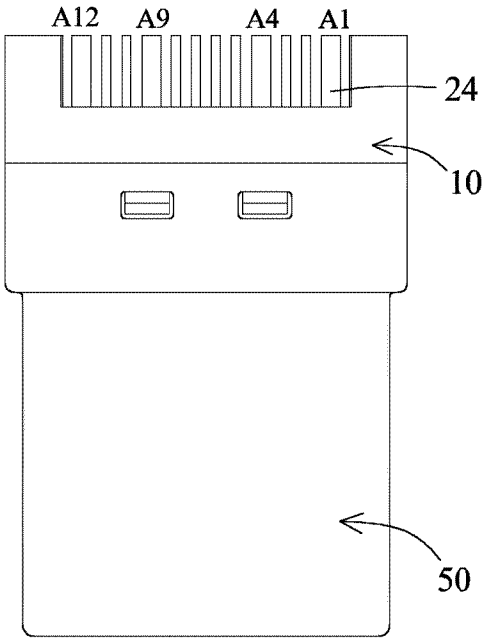
FIG. 4 is a top view showing the first embodiment of the invention.
Figure 3:
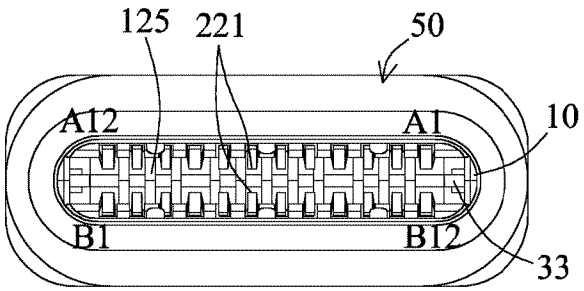
FIG. 3 is a front view showing the first embodiment of the invention.
Figure 7:
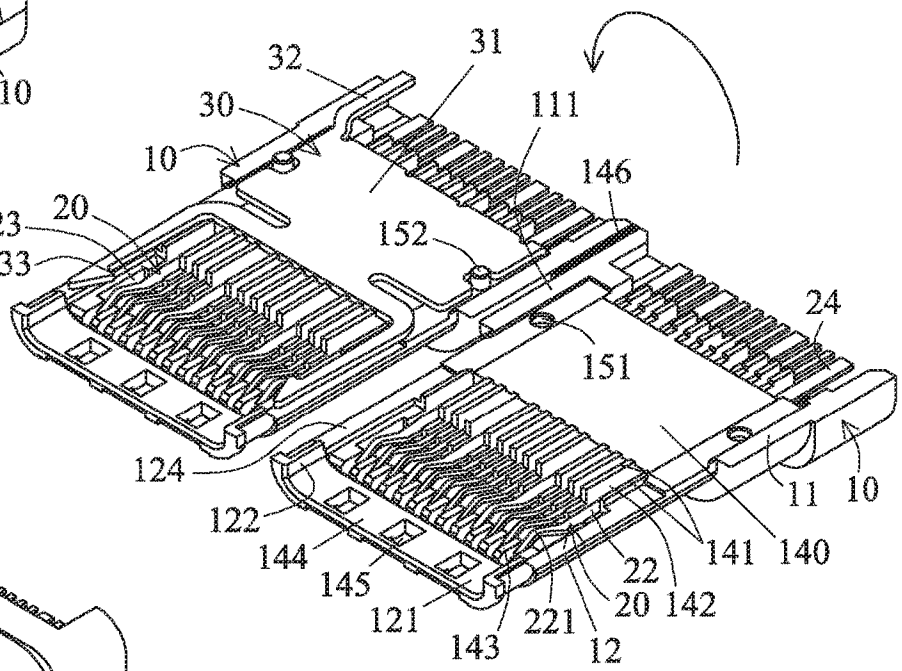
FIG. 7 is a pictorial view showing the first embodiment of the invention.
Figure 5:
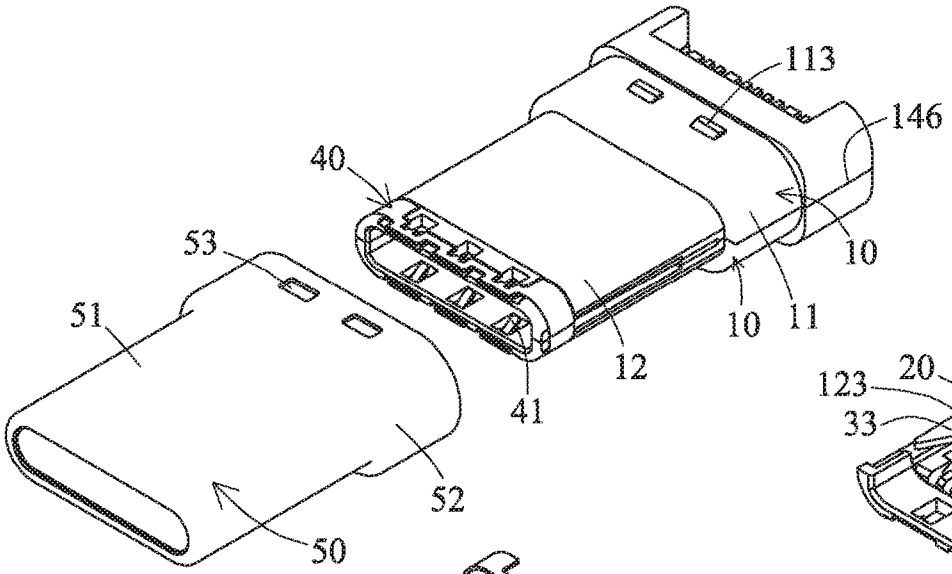
FIG. 5 is a pictorially exploded view showing the first embodiment of the invention.
Figure 6:
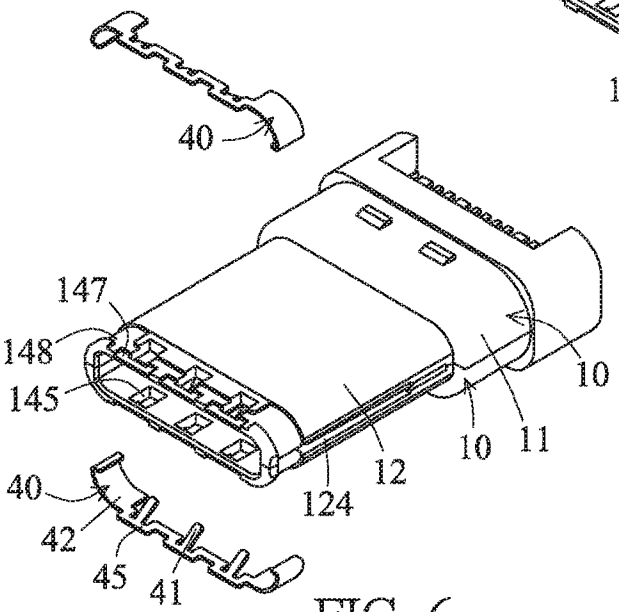
FIG. 6 is a pictorially exploded view showing the first embodiment of the invention.

First, as shown in FIG. 2, because the rear sections 223 of the elastically movable portions and the fixing portions 23 of two rows of terminals are on the same level and rest against the bottom surfaces of the terminal slots, easy assembling can be achieved and stamping can be simplified, the manufacturing cost can be decreased, and the rear section 223 of the elastically movable portion of the terminal horizontally rests against the bottom surface of the terminal slot so that the support effect of the middle section of the elastic arm can be obtained, thereby increasing the normal force of contacting the terminal and the resilience. As shown in FIG. 2A, when the elastically movable portion 22 of each of the two rows of terminals is forced to move elastically, the rear section 223 of the elastically movable portion pertaining to the elastically movable portion 22, which is elastically movable up and down, is formed with a middle-section fulcrum 224 supported by the bottom surface 1421 of the terminal slot according to the principle of mechanics. So, the rear section 223 of the elastically movable portion exclusive of the middle-section fulcrum 224 still can be partially separated from the bottom surface 1421 of the terminal slot and is curved to move elastically to form a gap GP between the bottom surface 1421 of the terminal slot of the base portion 11 and the rear section 223 of the elastically movable portion, thereby increasing the contact normal force and resilience of the terminal.

Second, two plastic seats 10 are integrally formed by way of plastic injection molding and are integrally connected together via the plastic material bridge 146, so that the assembling speed is doubled.

Third, the ground terminal and the power terminal have the requirements of transmitting the high current. In the design of this embodiment, the plate widths of the rear section 223 of the elastically movable portion to the pins 24 of A1, A4, A9, A12, B1, B4, B9 and B12 of the two rows of terminals are wider than other terminals.

Referring to FIGS. 13 to 15, the first modification implementation of the first embodiment is substantially the same as the first embodiment except for the following differences. The upper and lower insulation seats 10 of this modification implementation are provided separately, and no plastic material bridge for integral connection is provided. In addition, the positioning sheet 42 and the twisting sheet 45 of the ground member 40 surround to form a frame body.

Figure 16:
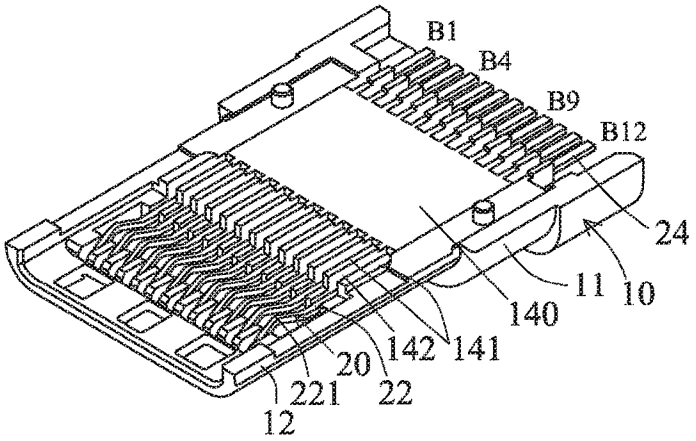
FIG. 16 is a pictorially exploded view showing the second modification implementation according to the first embodiment of the invention.

Referring to FIG. 16, the second modification implementation of the first embodiment is substantially the same as the first modification implementation of the first embodiment except for the difference that all terminals of two rows of terminals 20 in this modification implementation have the same width and thickness.

Figure 18:
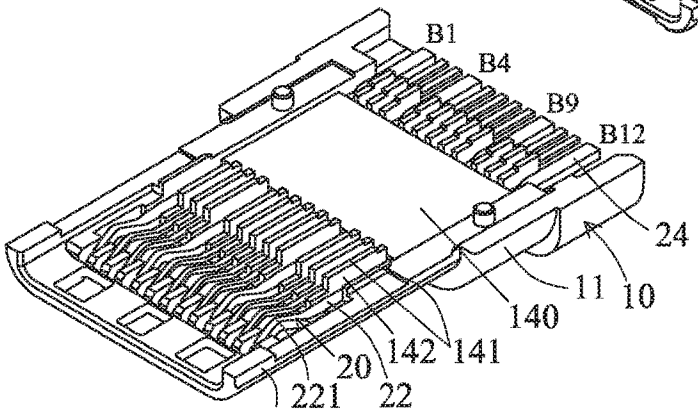
FIG. 18 is a pictorial view showing the third modification implementation according to the first embodiment of the invention.
Figure 17:
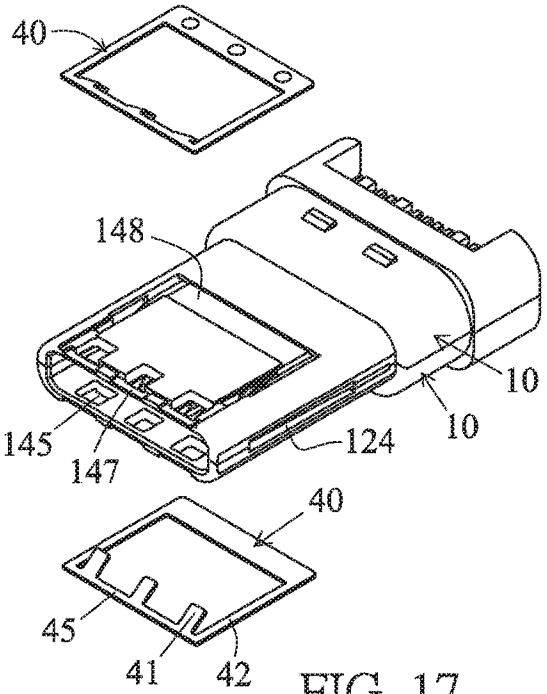
FIG. 17 is a pictorially exploded view showing the third modification implementation according to the first embodiment of the invention.

Referring to FIGS. 17 and 18, the third modification implementation of the first embodiment is substantially the same as the first modification implementation of the first embodiment except for the difference that: the ground terminals (A1, A12, B1, B12) and the power terminals (A4, A9, B4, B9) of the two rows of terminals 20 of this modification implementation are light and other terminals are wider and thicker. In addition, the positioning sheet 42 and the twisting sheet 45 of the ground member 40 surround to form a frame body, and the twisting sheet 45 is not provided with U-shaped curve shape.

Figure 19:
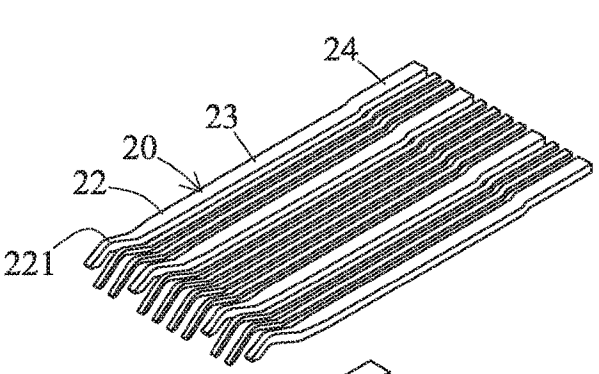
FIG. 19 is a pictorially exploded view showing the fourth modification implementation according to the first embodiment of the invention.
Figure 19:
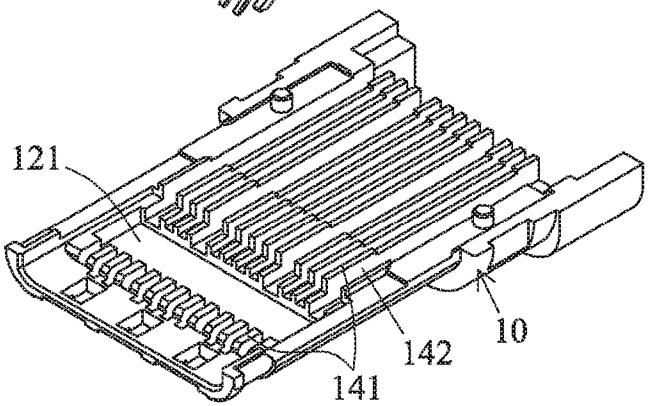
Figure 20:
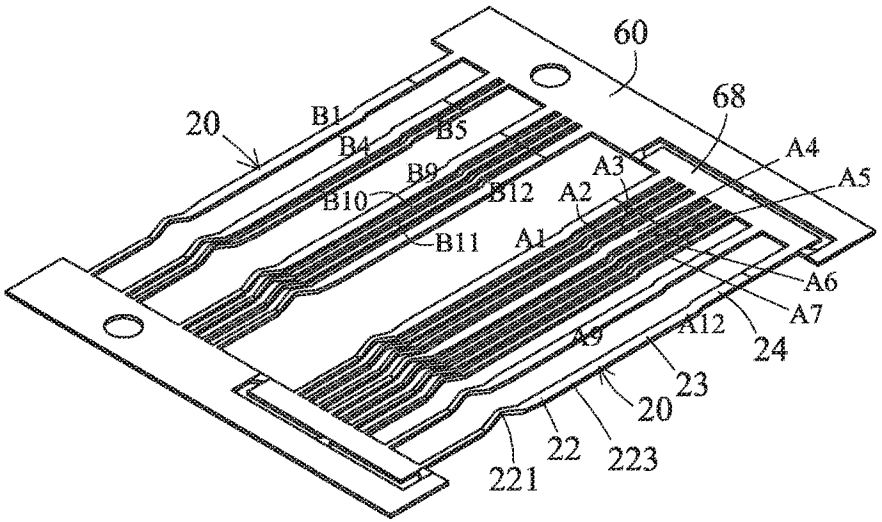
FIG. 20 is a pictorial view showing the fourth modification implementation according to the first embodiment of the invention.

Referring to FIGS. 19 and 20, the fourth modification implementation of the first embodiment is substantially the same as the third modification implementation of the first embodiment except for the following differences. The front ends of the contacts of the thicker and wider ground terminals (A1, A12, B1, B12) and power terminals (A4, A9, B4, B9) of the two rows of terminals 20 of this modification implementation have the inclined front end portions, which are shorter and do not rest against the baseplate 121, the front ends of the contacts of the other thinner and narrower terminals have the inclined front end portions, which are longer and rest against the baseplate 121.

Figure 21:
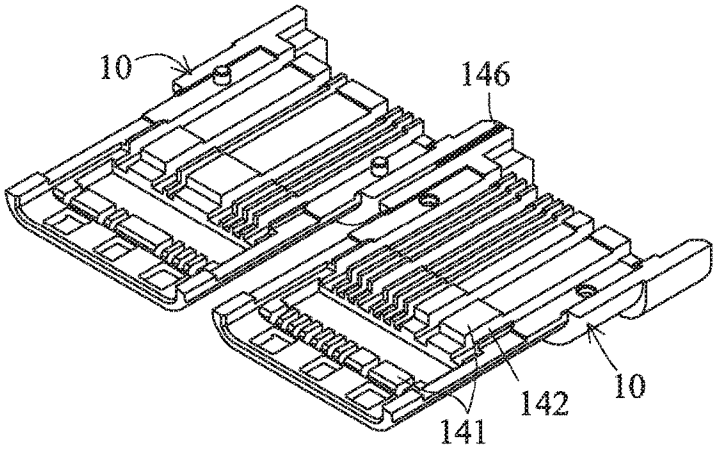
FIG. 21 is a pictorially exploded view showing the fifth modification implementation according to the first embodiment of the invention.
Figure 22:
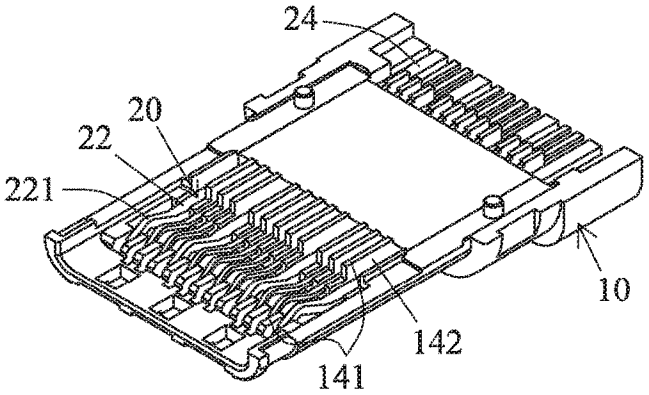
FIG. 22 is a pictorial view showing the fifth modification implementation according to the first embodiment of the invention.
Figure 23:
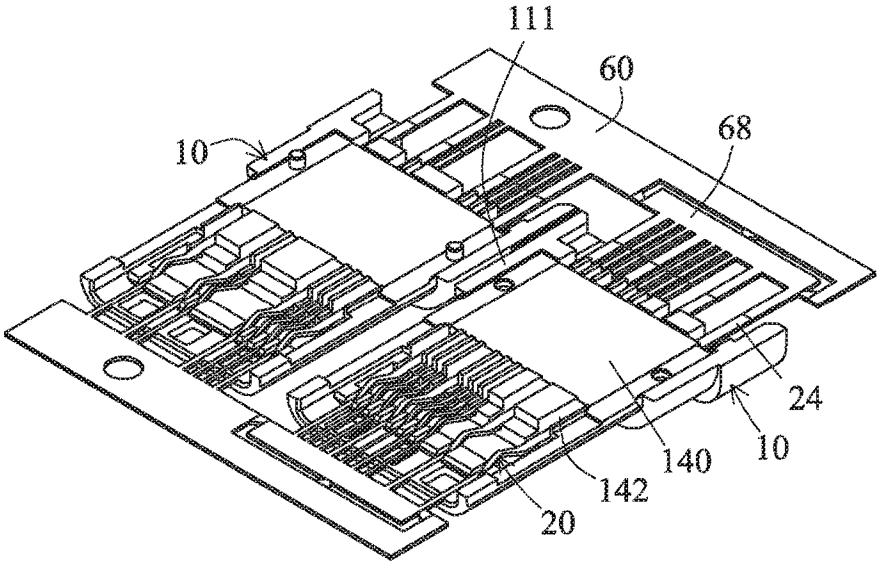
FIG. 23 is a front view showing the second embodiment of the invention.
Figure 25:
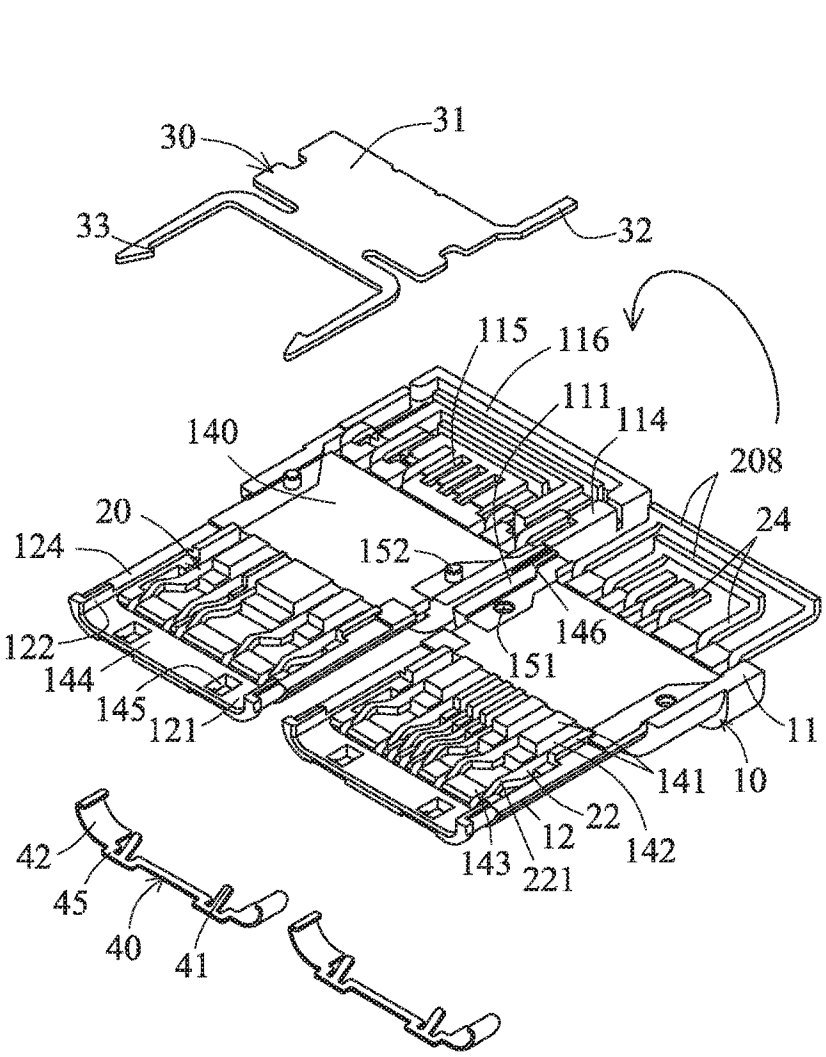
FIG. 25 is a pictorially exploded view showing the second embodiment of the invention.
Figure 24:
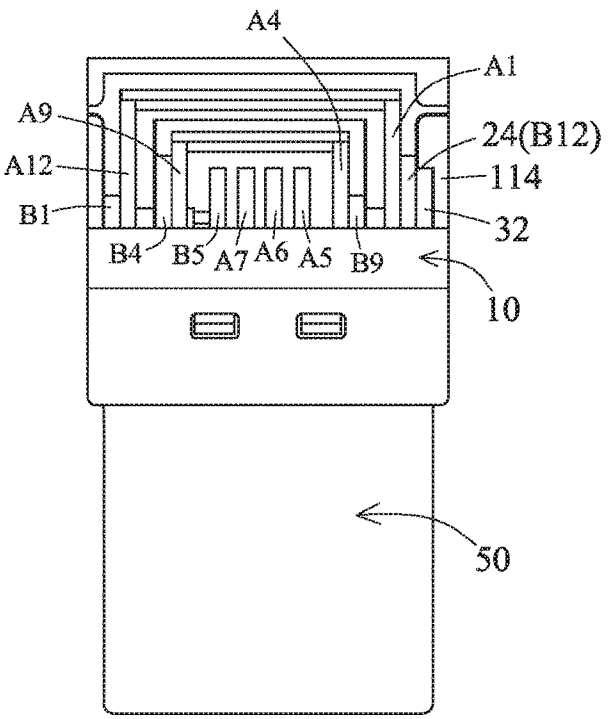
FIG. 24 is a top view showing the second embodiment of the invention.
Figure 23:
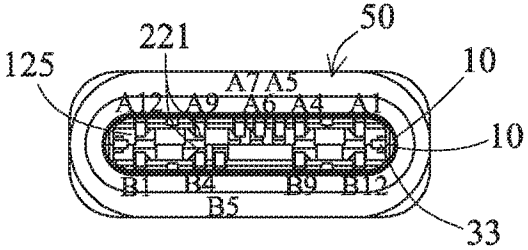

Referring to FIGS. 21 and 22, the fifth modification implementation of the first embodiment is substantially the same as the first embodiment except for the following differences. The high differential signal terminals of the upper row of terminals 20 of this modification implementation are only provided with one pair of high differential signal terminals (TX+, TX−) A2/A3, and the high differential signal terminal of the lower row of terminals 20 are also only provided with one pair of high differential signal terminals (RX+, RX−) B10/B11. In addition, the upper row of terminals 20 are provided with one pair of low differential signal terminals (D+, D−) A6/A7, and the lower row of terminals 20 are not provided with one pair of low differential signal terminals (D+, D−) B6/B7.

Referring to FIGS. 23 to 26, the second embodiment of the invention provides a bidirectional duplex USB TYPE-C 2.0 electrical plug, which is substantially the same as the first embodiment except for the following differences. The upper row of terminals 20 of this embodiment are provided with seven terminals A1, A4, A5, A6, A7, A9 and A12, and the lower row of terminals 20 are provided with five terminals B1, B4, A5, B9 and B12. The base portion 11 of the lower insulation seat 10 extends backwards much more than the base portion of the upper insulation seat 10 to form a projecting bonding pad 114, the bonding pad 114 provided with one row of pin slots 115 and four U-shaped slots 116. The pins 24 of the one pair of power terminals B4/B9 of the lower row of terminals 20 are integrally connected to a U-shaped connection sheet 208. The pins 24 of the one pair of ground terminals B1/B12 are integrally connected to a U-shaped connection sheet 208. The two U-shaped connection sheets 208 extend backwards and bypass the pin of the middle terminal and are in the form of a large U shape covering a small U shape. The two U-shaped connection sheets 208 and the pins of the lower row of terminals have a height difference. The pins 24 of one pair of power terminals A4/A9 of the upper row of terminals 20 are integrally connected to a U-shaped connection sheet 208. The pins 24 of the one pair of ground terminals B1/B12 are integrally connected to a U-shaped connection sheet 208. The two U-shaped connection sheets 208 extend backwards and bypass the pin of the middle terminal and are in the form of a large U shape covering a small U shape. The two U-shaped connection sheets 208 are bent by 90 degrees so that the left and right extension segments of the two U-shaped connection sheets 208 and the pins of the upper row of terminals have a height difference. When the two insulation seats 10 are vertically stacked, the pins 24 of the two rows of terminals are in flat surface contact with and arranged in the one row of pin slots 115, wherein the vertically aligned A1 and B12 are ground terminals, A12 and B1 are ground terminals, A4 and B9 are power terminals, so the pins 23 of the four pairs of terminals are parallel to each other on the same horizontal level or adjacently arranged near the pin slot 115 of the bonding pad 114.

The method of manufacturing this embodiment will be described in the followings.

Referring to FIG. 26, the two rows of terminals 20 are provided. The two rows of terminals 20 are formed by stamping the same metal sheet and are arranged adjacently, the front ends of the two rows of terminals 20 are connected to a material tape 60, the left and right sides of the larger U-shaped connection sheet 208 of the lower row of terminals 20 are connected to a material tape 60, the pins 24 of the terminals B1/B4, B4/B5, B9/B12 are connected together through a dummy material tape 215, the fixing portion of the terminals B12/A1 are connected together through a dummy material tape 215, and the two rows of terminals 20 having the connection points with the same circuit serial numbers are arranged in the same direction in order. The two insulation seats 10 is provided. The two insulation seats 10 is integrally plastic injection molded. The first sides of the base portions 11 of the two insulation seats 20 are respectively integrally provided with plastic material bridges 146 mutually connected together.

Referring to FIG. 27, the two rows of terminals 20 are then assembled into the two rows of terminal slots 142 of the two insulation seats 10 in the vertical direction. The rear sections 223 of the elastically movable portions and the fixing portions 23 of the two rows of terminals 20 are on the same level and rest against the bottom surfaces of the two rows of terminal slots 142 of the two insulation seats 10. The depth of the terminal slot 142 is greater than the material thickness of the terminal 20, so that the rear section 223 of the elastically movable portion and the fixing portion 23 fall into the terminal slot 142.

Referring to FIG. 28, the fixing structure 140 is formed at the position corresponding to the fixing portion 23 by way of secondary processing and encapsulant. The fixing portion 140 covers the fixing portions 23 of the one row of terminals 20 and has a plane slightly depressed from the connection surface 111.

Figure 29:
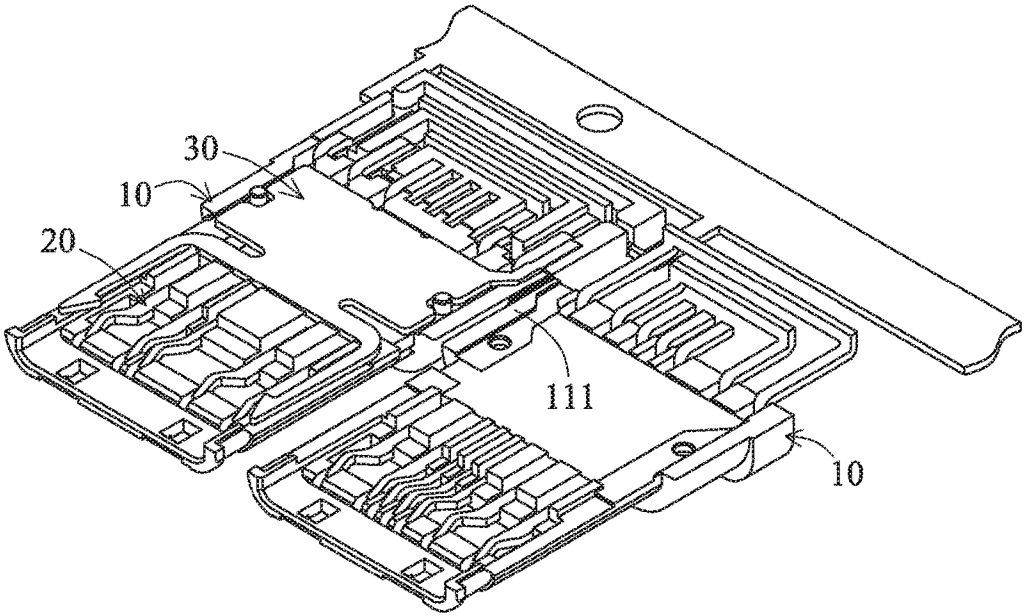
FIG. 29 is a pictorial view showing the manufacturing process according to the second embodiment of the invention.

Referring to FIG. 29, each dummy material tape 215 is then cut off, and the metal partition plate 30 is provided and placed on the fixing portion 140 of one insulation seat 10. At this time, the material tape 60 on the front ends of the two rows of terminals is cut off.

Figure 30:
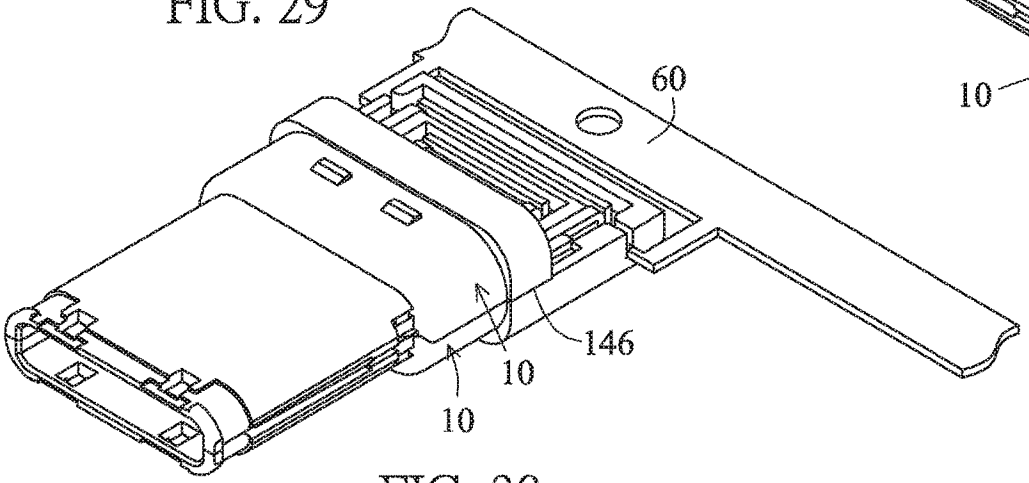
FIG. 30 is a pictorial view showing the manufacturing process according to the second embodiment of the invention.

Referring to FIG. 30, the insulation seat 10 separated from the material tape is then flipped by 180 degrees and stacked over the other insulation seat 10, so that the two insulation seats 10 are vertically stacked. At this time, two rows of terminals 20 having the connection points with the same circuit serial numbers are arranged reversely in order.

Figure 31:
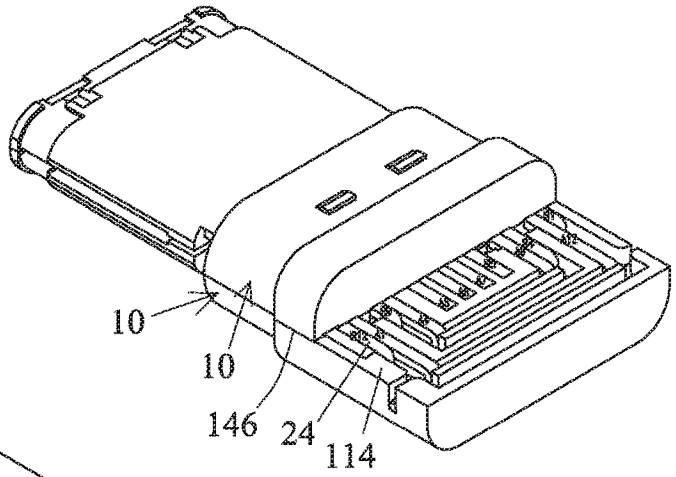
FIG. 31 is a pictorial view showing the manufacturing process according to the second embodiment of the invention.
Figure 33:
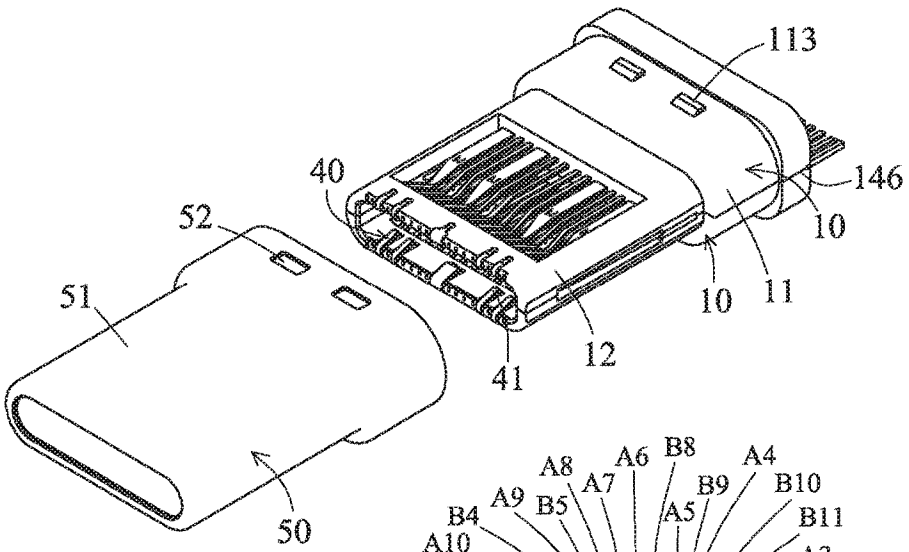
FIG. 33 is a pictorially exploded view showing the third embodiment of the invention.
Figure 34:
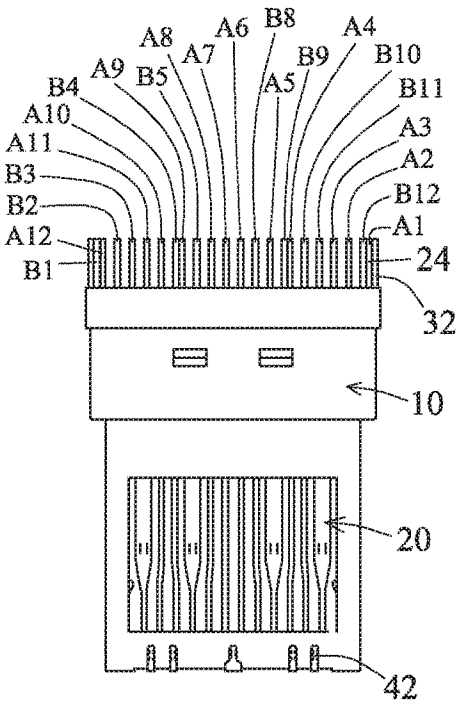
FIG. 34 is a top view showing the third embodiment of the invention.

Referring to FIG. 31, the material tape 60 connected to the lower row of terminals is cut off.

Furthermore, the fixing structures of the two insulation seats 20 for fixing the terminals 20 may also lock the terminals by hot melting the separation columns between the terminal slot 142, or the terminal slot 142 is provided with the slot structure. When the terminal is placed into the terminal slot in the vertical direction and then shifted in a front-rear direction, the slot structure can lock the fixing portion of the terminal.

The four pairs of terminals of the upper and lower rows of terminals 20 with the same circuit in this embodiment are integrally connected together through the U-shaped connection sheet 208, so that the number of bonding wires of the pins can be decreased.

Figure 32A:
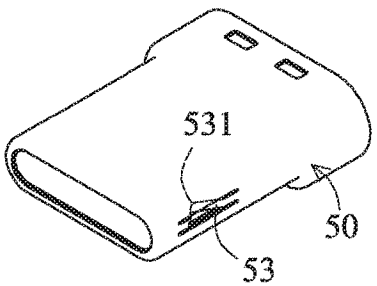
FIG. 32A is a pictorial view showing the second modification implementation according to the first embodiment of the invention.
Figure 32:
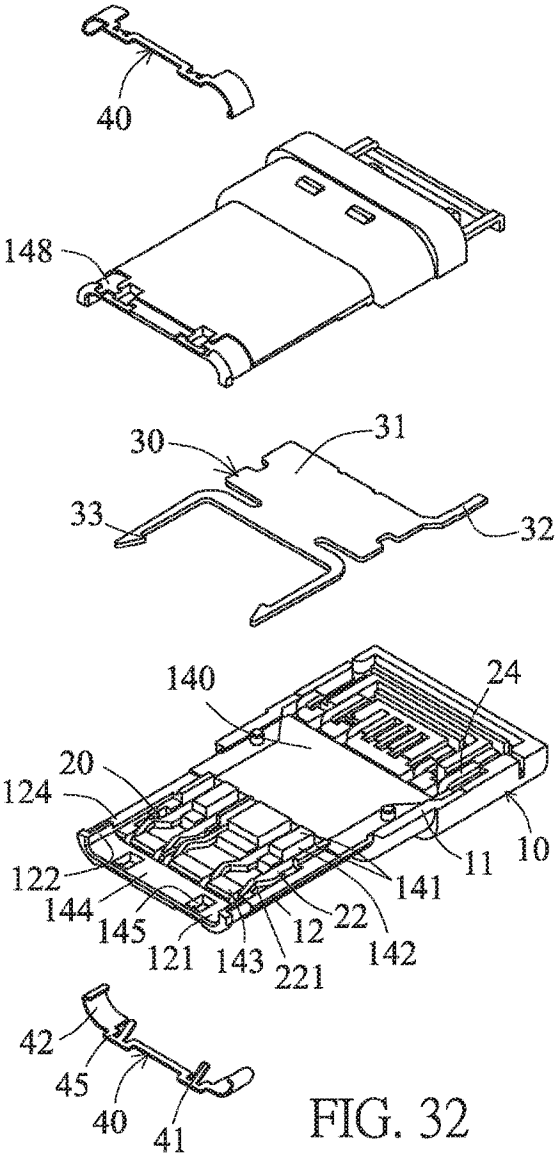
FIG. 32 is a pictorially exploded view showing the first modification implementation according to the second embodiment of the invention.
Figure 35:
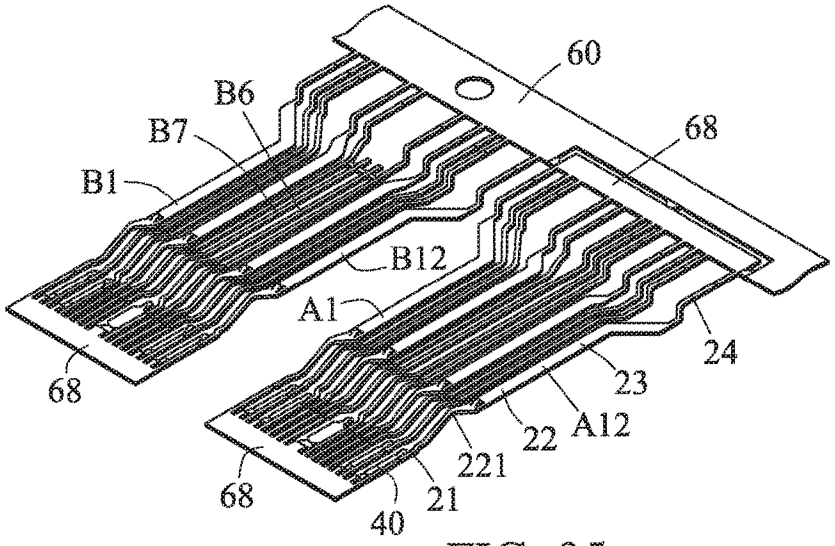
FIG. 35 is a pictorial view showing the manufacturing process according to the third embodiment of the invention.
Figure 37:
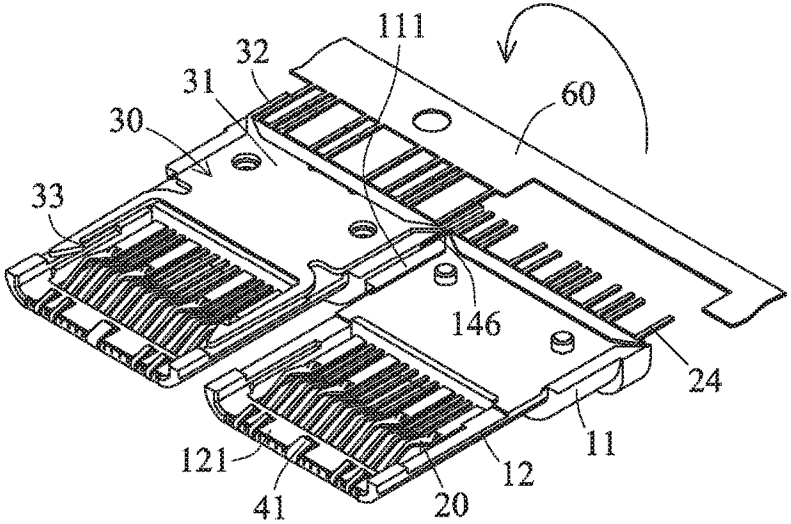
FIG. 37 is a pictorial view showing the manufacturing process according to the third embodiment of the invention.
Figure 36:
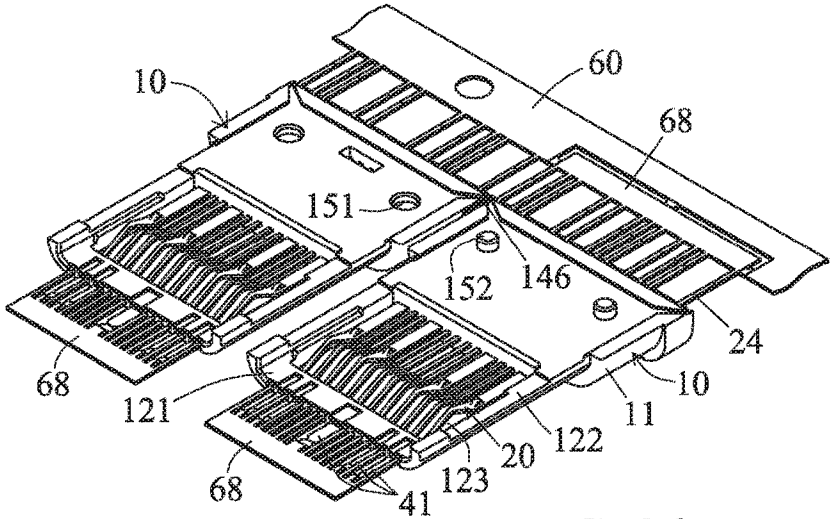
FIG. 36 is a pictorial view showing the manufacturing process according to the third embodiment of the invention.
Figure 38:
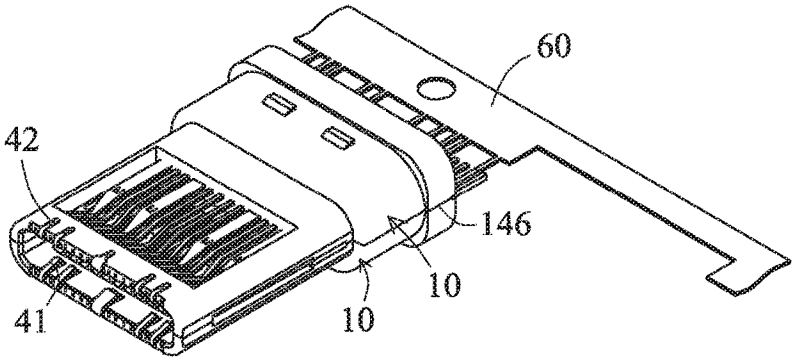
FIG. 38 is a pictorial view showing the manufacturing process according to the third embodiment of the invention.
Figure 39:
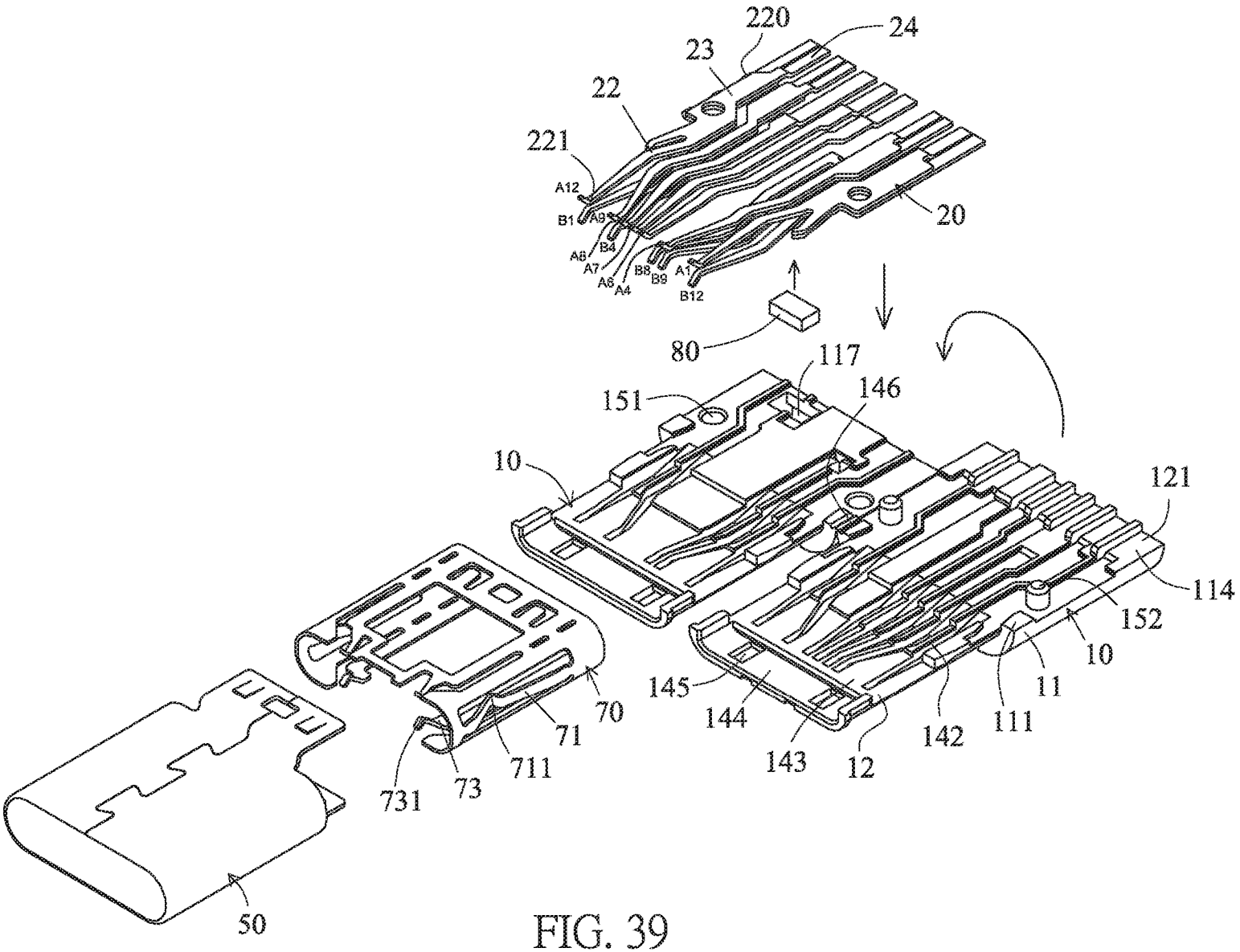
FIG. 39 is a pictorially exploded view showing the fourth embodiment of the invention.

Referring to FIG. 32, the first modification implementation of the second embodiment is substantially the same as the second embodiment except for the following differences. The upper and lower insulation seats 10 of this modification implementation are provided separately, and no plastic material bridge for integral connection is provided.

Referring to FIG. 32A, the second modification implementation of the second embodiment is substantially the same as the second embodiment except for the following differences. This modification implementation is not provided with the metal partition plate. However, each of left and right side plates of the metal housing 50 is prodded inwardly and projectingly provided with a resilient snap 53, and the resilient snap 53 is provided with a projecting snap 531.

Referring to FIGS. 33 to 38, the third embodiment of the invention provides a bidirectional duplex USB TYPE-C 3.0 electrical plug and is substantially the same as the first embodiment except for the following differences. The two rows of terminals 20 and multiple ground members 40 are formed by stamping the same metal sheet, and concurrently embedded into, injection molded with and fixed to the two insulation seats 10. The front end portions 21 of the two rows of terminals 20 and the fixing portions of the multiple ground members 40 are embedded into and fixed to the baseplate 121 of the docking portion 12. The first sides of the base portions of the two insulation seats 20 are respectively integrally provided with plastic material bridges 146 mutually connected together. When one insulation seat 20 is flipped by 180 degrees, the two insulation seats 20 are vertically stacked.

Referring to FIGS. 39 to 45, the fourth embodiment of the invention provides a bidirectional duplex USB TYPE-C 2.0 electrical plug, which is substantially the same as the second embodiment except for the following differences. The depth of the terminal slot 142 of the base portion 11 of this embodiment two insulation seats 10 is substantially the same as the material thickness of the terminal 20. When the two rows of terminals 20 are placed into the terminal slots 142 of the two insulation seats 10, and when the fixing portions 23 of the two rows of terminals 20 are in flat surface contact with the terminal slots 142 of the base portion 11 of the two insulation seats 10, the fixing portions 23 are substantially flush with the connection surface 111. The lower insulation seat 10 is provided with a slot 117 for placement of a resistor 80. The resistor 80 can be electrically connected to two terminals. In the two rows of terminals 20, the vertically aligned A1 and B12 are ground terminals, A12 and B1 are ground terminals, A4 and B9 are power terminals, the four pairs of fixing portions of the terminals 23 mutually rest against each other, and the pins 24 are parallel to each other on the same horizontal level or adjacently arranged the pin slot 115 of the bonding pad 114. In addition, one side of the fixing portion 23 of the ground terminal A12/B1 is provided with a metal material bridge 220 integrally connected together, and the resistor 80 is electrically connected to the terminal.

In addition, this embodiment is provided with a metal inner housing 70 fitting with the docking portions 12 of the two insulation seats 10, each of two side plates of the metal inner housing 70 is inwardly and projectingly provided with a resilient snap 71, the resilient snap 53 is provided with a projecting snap 711, each of the top and bottom plates of the metal inner housing 70 is provided with two elastic ground sheets 73, and the elastic ground sheet 73 is provided with a projecting contact 731.

The method of manufacturing this embodiment will be described in the followings.

Figure 41:
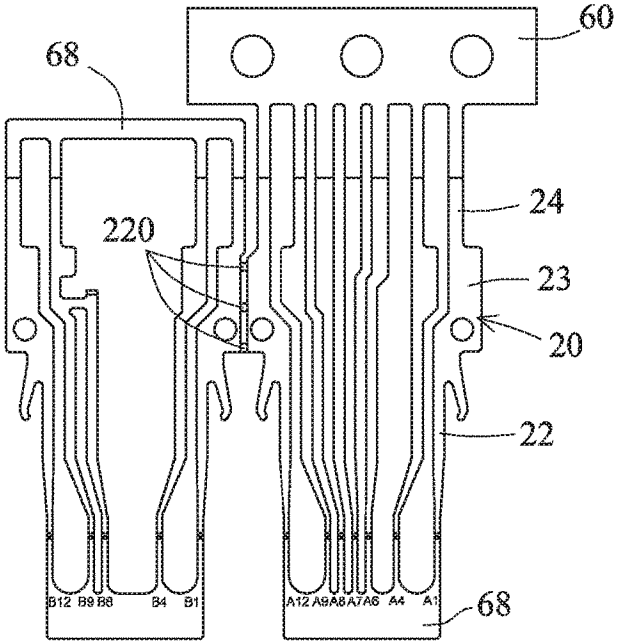
FIG. 41 is a deployed plane view showing two rows of terminals according to the fourth embodiment of the invention.
Figure 42:
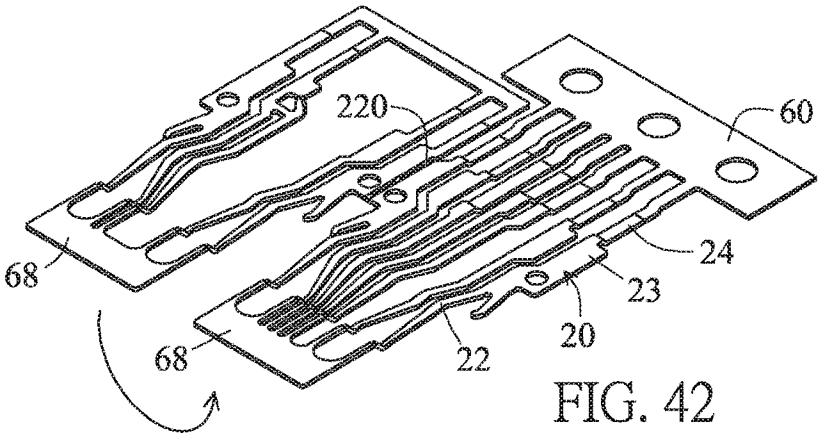
FIG. 42 is a deployed pictorial view showing two terminals according to the fourth embodiment of the invention.
Figure 40:
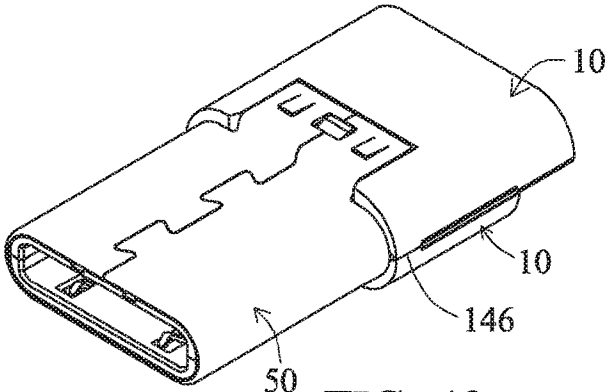
FIG. 40 is a pictorial view showing the fourth embodiment of the invention.

Referring to FIGS. 41 and 42, the two rows of terminals 20 are provided. The two rows of terminals 20 are formed by stamping the same metal sheet and are arranged adjacently, the rear ends of the upper row of terminals 20 are connected to a material tape 60, and the front ends of the upper row of terminals 20 are connected to a sub-material tape 68. The front and rear ends of the lower row of terminals 20 are connected to the two sub-material tapes 68. One side of the fixing portion 23 of the ground terminal A12/B1 is provided with a metal material bridge 220 integrally connected together.

Figure 43:
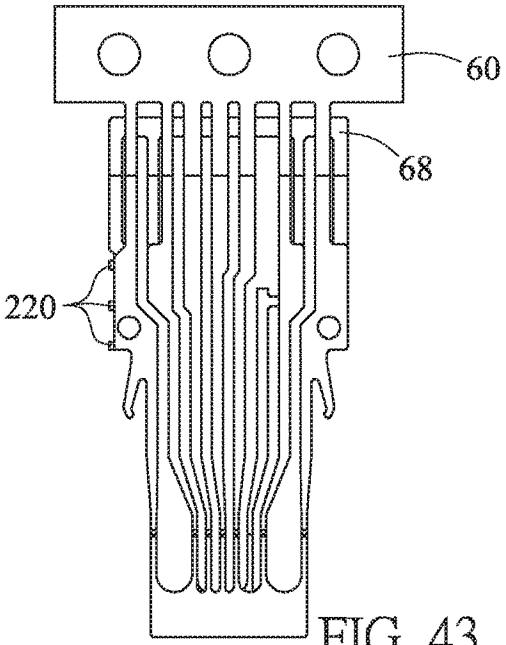
FIG. 43 is a stacked plane view showing two terminals according to the fourth embodiment of the invention.

Referring to FIG. 43, the lower row of terminals 20 are downwardly flipped by 180 degrees and stacked under the upper row of terminals 20.

Figure 44:
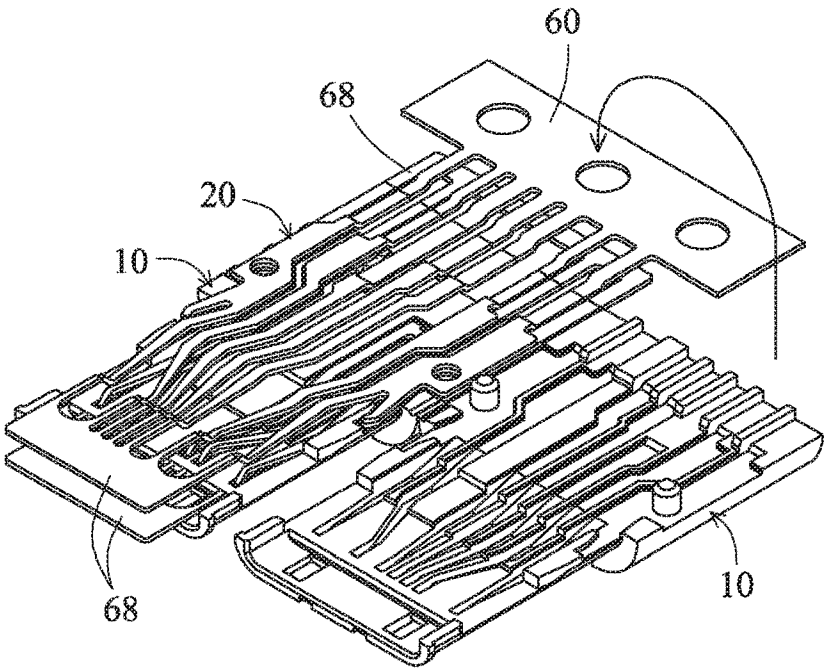
FIG. 44 is a pictorial view showing the manufacturing process according to the fourth embodiment of the invention.

Referring to FIG. 44, the stacked two rows of terminals 20 are placed in the terminal slots 142 of the lower insulation seat 10.

Figure 45:
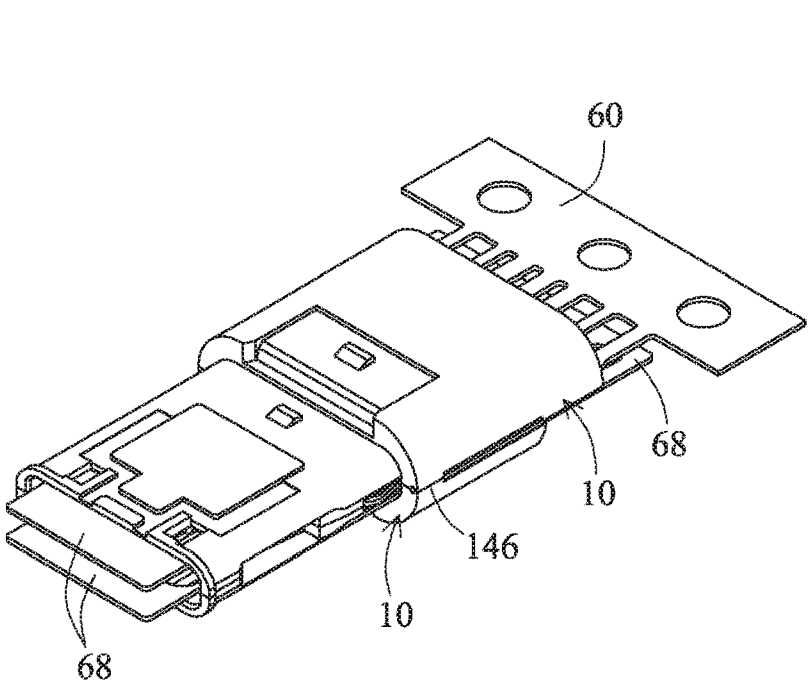
FIG. 45 is a pictorial view showing the manufacturing process according to the fourth embodiment of the invention.

Referring to FIG. 45, the upper insulation seat 10 is flipped by 180 degrees and stacked over the lower insulation seat 10. At this time, the vertically aligned fixing portions of the terminals 23 of the two rows of terminals 20 mutually rest against each other for positioning, and the staggered upper and lower terminals rest against the connection surface of the insulation seat 10 for positioning.

Figure 46:
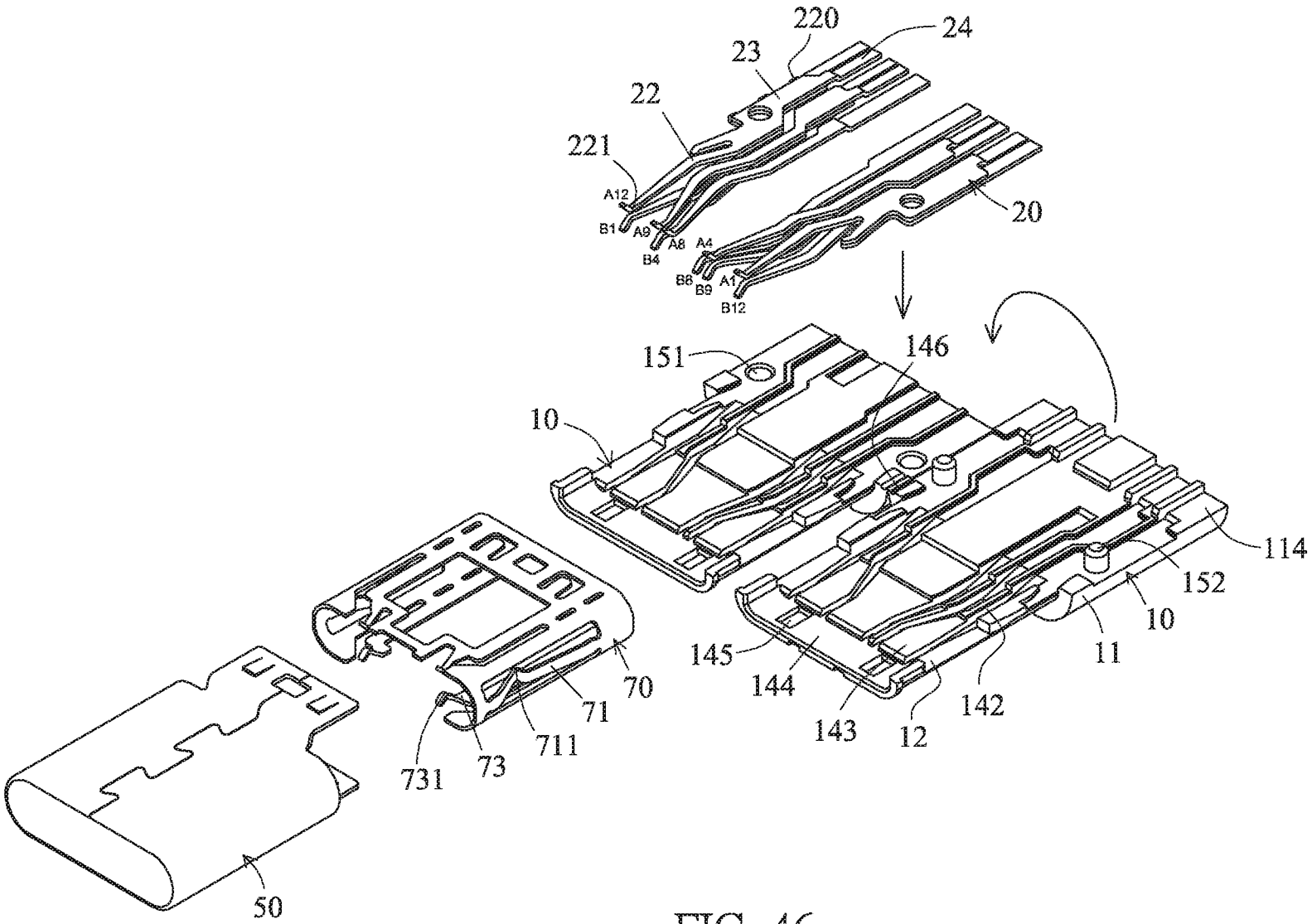
FIG. 46 is a pictorially exploded view showing the first modification implementation according to the fourth embodiment of the invention.
Figure 47:
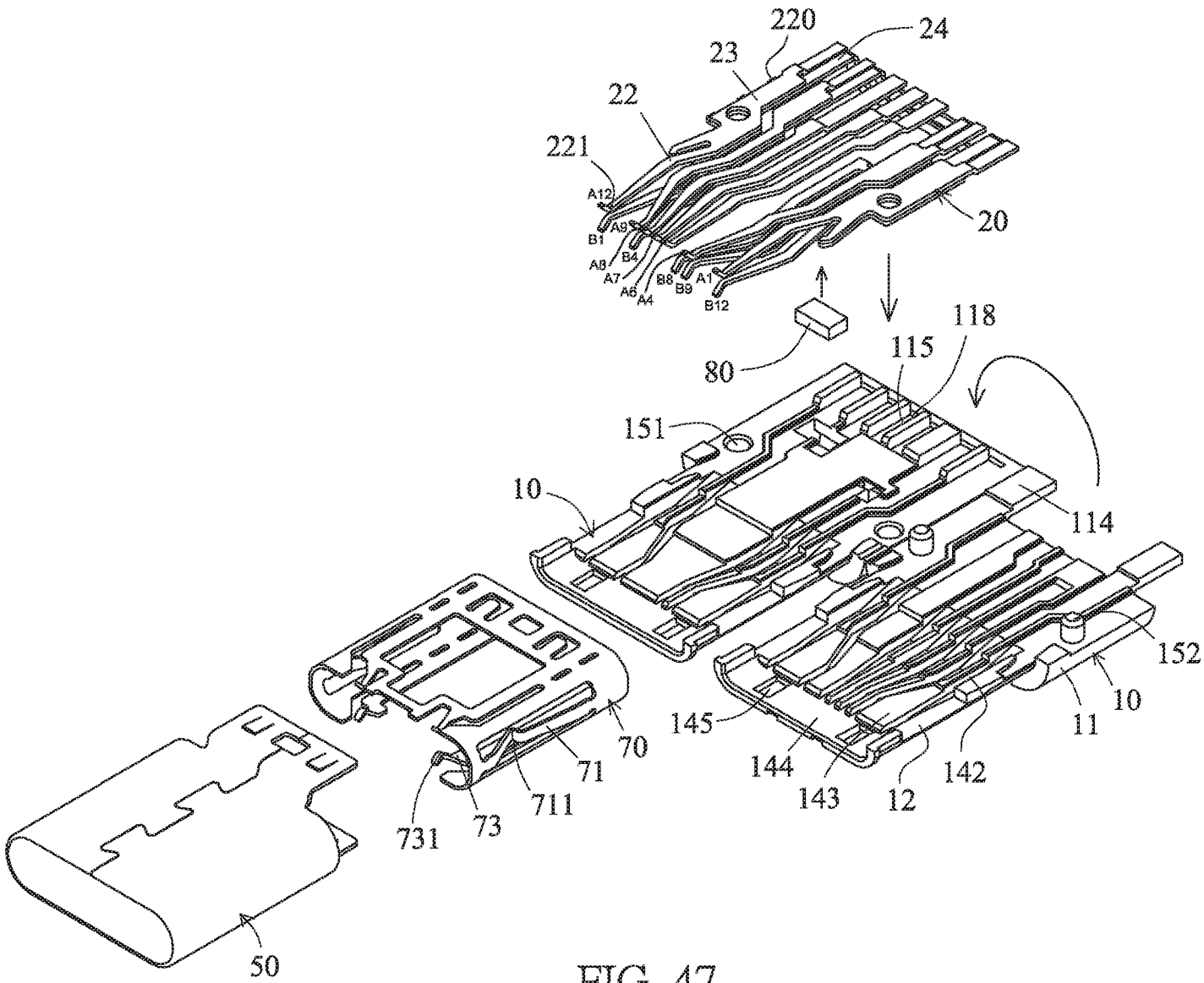
FIG. 47 is a pictorially exploded view showing the second modification implementation according to the fourth embodiment of the invention.
Figure 50:
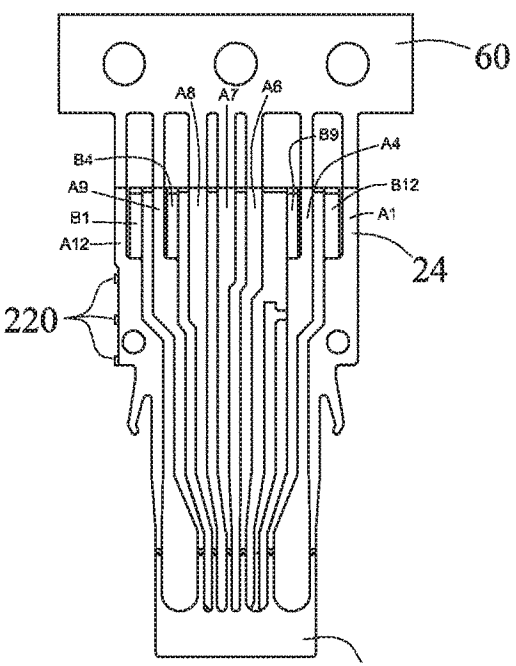
FIG. 50 is a stacked plane view showing two rows of terminals of the second modification implementation according to the fourth embodiment of the invention.
Figure 49:
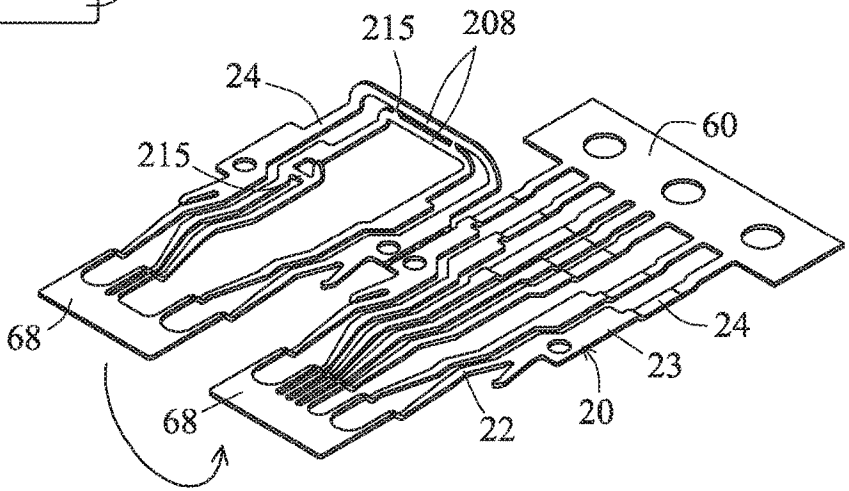
FIG. 49 is a deployed pictorial view showing two rows of terminals of the second modification implementation according to the fourth embodiment of the invention.
Figure 48:
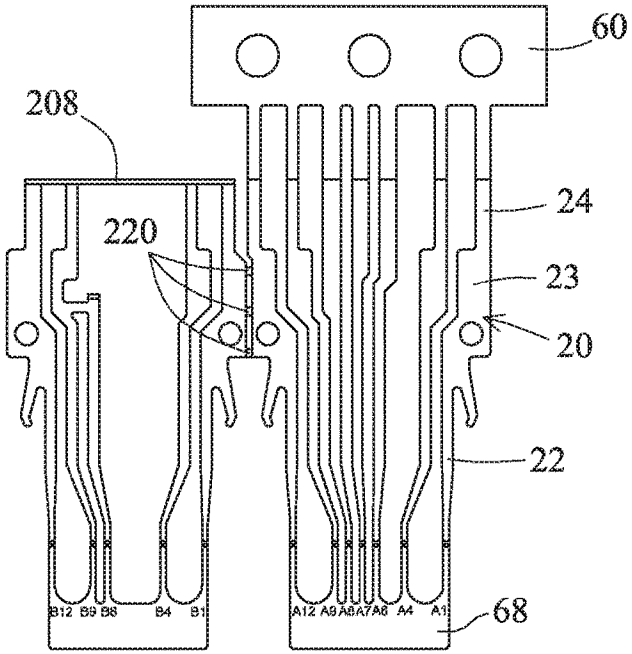
FIG. 48 is a deployed plane view showing two rows of terminals of the second modification implementation according to the fourth embodiment of the invention.
Figure 52:
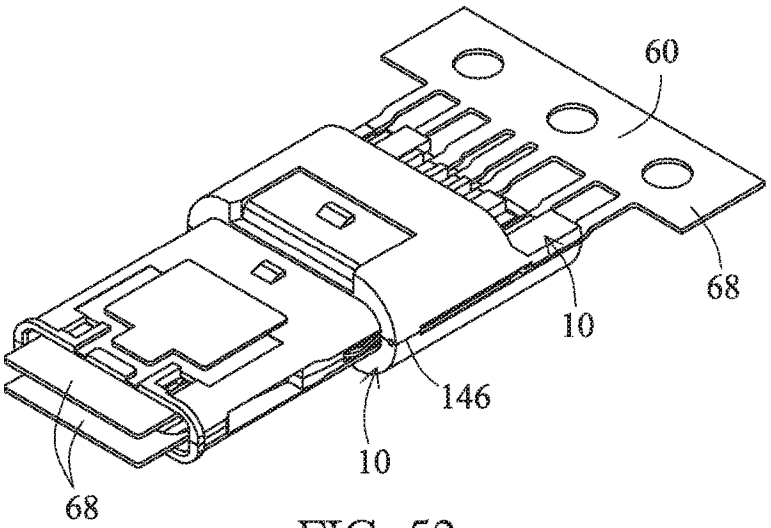
FIG. 52 is a pictorial view showing the manufacturing process of the second modification implementation according to the fourth embodiment of the invention.
Figure 51:
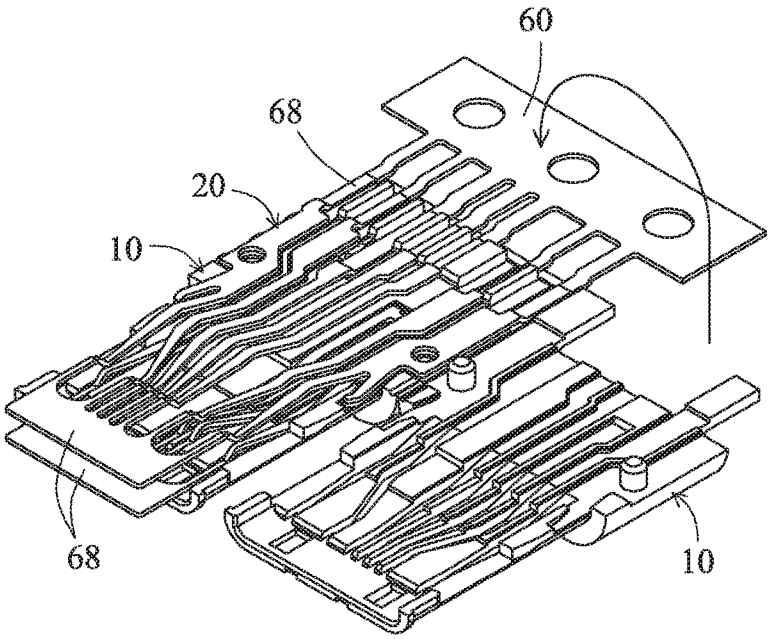
FIG. 51 is a pictorial view showing the manufacturing process of the second modification implementation according to the fourth embodiment of the invention.

Referring to FIG. 46, the first modification implementation of the fourth embodiment is substantially the same as the fourth embodiment except for the following differences. The upper row of terminals 20 of this modification implementation do not have terminals A6 and A7, and each of upper and lower rows of terminals have five terminals.

Referring to FIGS. 47 to 52, the second modification implementation of the fourth embodiment is substantially the same as the fourth embodiment except for the following differences. The pins 24 of the one pair of power terminals B4/B9 of the lower row of terminals 20 of the modification implementation are integrally connected to a U-shaped connection sheet 208. The pins 24 of the one pair of ground terminals B1/B12 are integrally connected to a U-shaped connection sheet 208. The two U-shaped connection sheets 208 extend backwards and bypass the pin of the middle terminal and are in the form of a large U shape covering a small U shape. The two U-shaped connection sheets 208 are bent by 90 degrees so that the left and right extension segments of the two U-shaped connection sheets 208 and the pins of the lower row of terminals 24 have a height difference, and left and right extension segments of the two U-shaped connection sheets 208 are provided with dummy material tapes 215 connected together. The left and right extension segments of the two U-shaped connection sheets 208 are fit into the slot 118 of the bonding pad 114.

Figure 53:
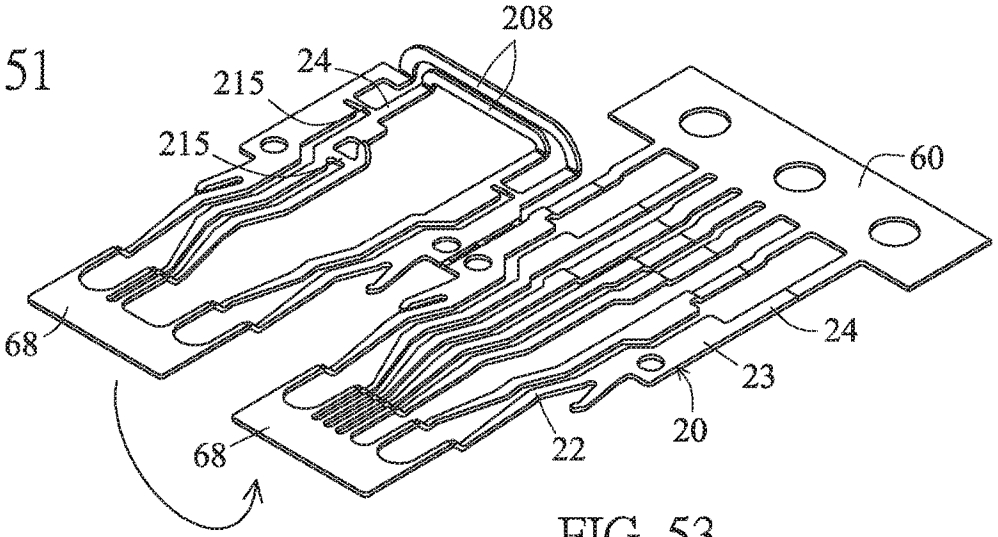
FIG. 53 is a deployed pictorial view showing two rows of terminals of the third modification implementation according to the fourth embodiment of the invention.
Figure 54:
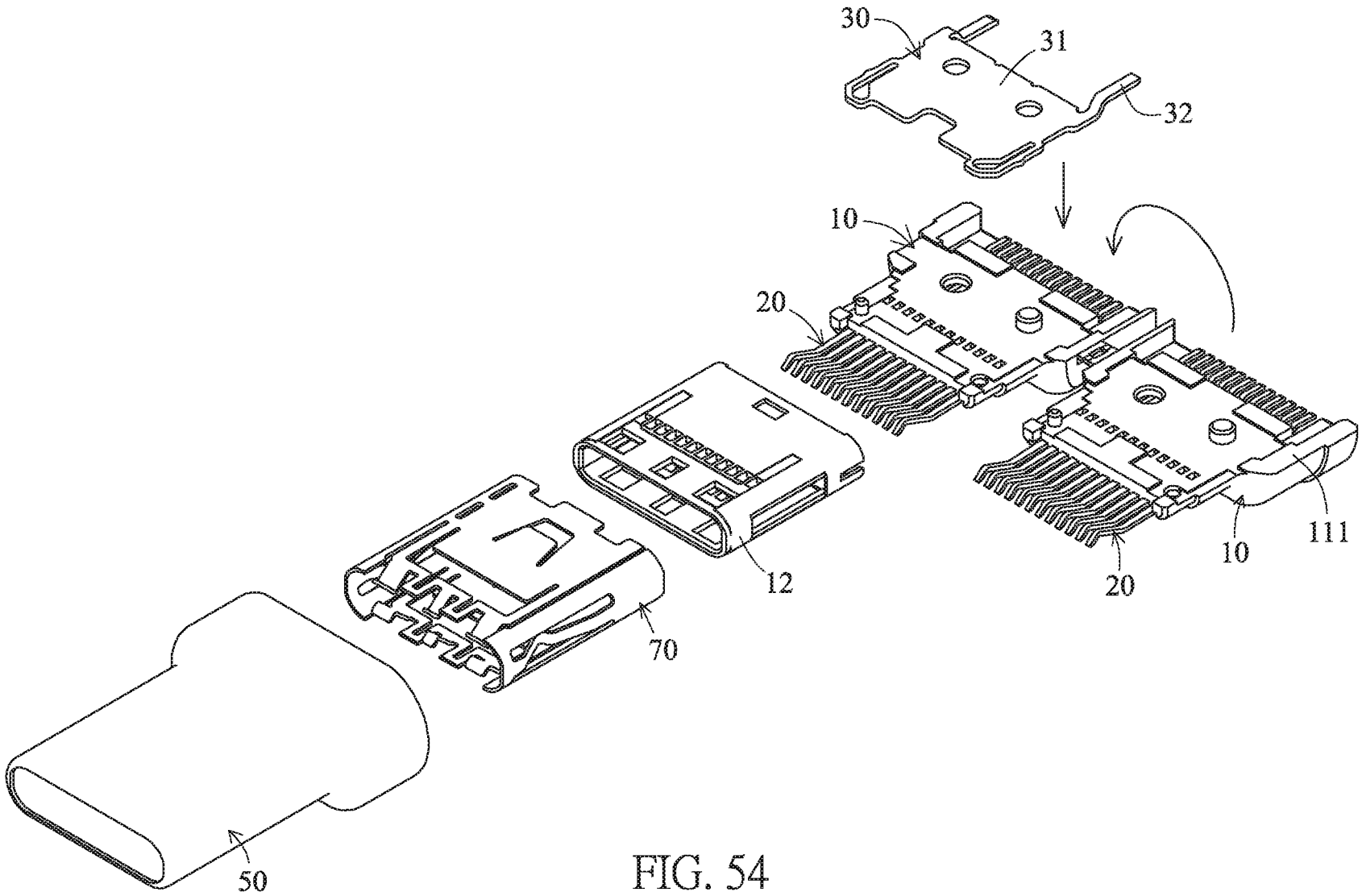
FIG. 54 is a pictorially exploded view showing the fifth embodiment of the invention.

Referring to FIG. 53, the third modification implementation of the fourth embodiment is substantially the same as the second modification implementation of the fourth embodiment except for the following differences. The fixing portions 23 of the terminals B12/B9 of the lower row of terminals 20 of the modification implementation are provided with dummy material tapes 215 connected together, and the fixing portions 23 of the terminals B4/B1 are provided with dummy material tapes 215 connected together.

Referring to FIGS. 54 to 58, the fifth embodiment of the invention provides a bidirectional duplex USB TYPE-C 3.0 electrical plug, which is provided with two insulation seats 10, two rows of terminals 20, a metal partition plate 30, a fitting frame body 83 and a metal housing 50, and is substantially the same as the first and fourth embodiments except for the following differences. The insulation seat 10 is provided with a base portion 11. The inner surfaces of the base portions 11 of the two insulation seats are provided with connection surfaces 111 resting against each other. The two rows of terminals 20 are embedded into, injection molded with and fixed to the two insulation seats 10. The fixing portions 23 of the ground terminals A1/B1 of the elastically movable portions 22 of the two rows of terminals 20 projecting beyond the two rows of terminals 20 are provided with metal material bridges 220 integrally connected together. The fitting frame body 83 is provided with top and bottom plates and two side plates surrounding to form a frame body. The fitting frame body 83 is fit with the front ends of the base portions 11 of the two insulation seats.

The method of manufacturing this embodiment will be described in the followings.

Referring to FIG. 55, the two rows of terminals 20 are provided. The two rows of terminals 20 are formed by stamping the same metal sheet and are arranged adjacently. The rear ends of the two rows of terminals 20 are connected to a material tape 60. Two rows of terminals 20 having the connection points with the same circuit serial numbers are arranged in the same direction in order. One side of the fixing portion 23 of the ground terminal A1/B12 is provided with a metal material bridge 220 integrally connected together. The metal material bridge 220 is provided with a projection 27, and the projection 27 and the fixing portion of the terminal have a height difference.

Figure 56:
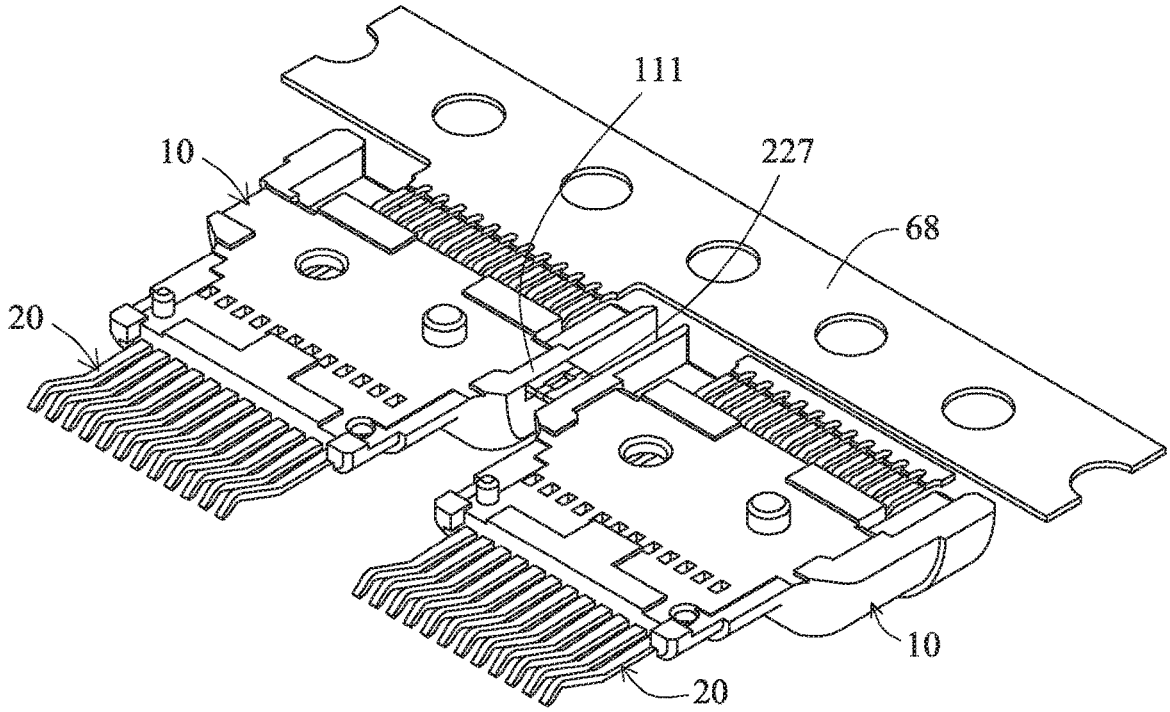
FIG. 56 is a pictorial view showing the manufacturing process according to the fifth embodiment of the invention.

Referring to FIG. 56, the two rows of terminals 20 are concurrently embedded into, injection molded with and fixed to the two insulation seats 10, wherein the projection 27 of the metal material bridge 220 is flush with the connection surfaces 111 of the base portions 11 of the two insulation seats. The lower row of terminals 20 are downwardly flipped by 180 degrees and stacked under the upper row of terminals 20.

Figure 57:
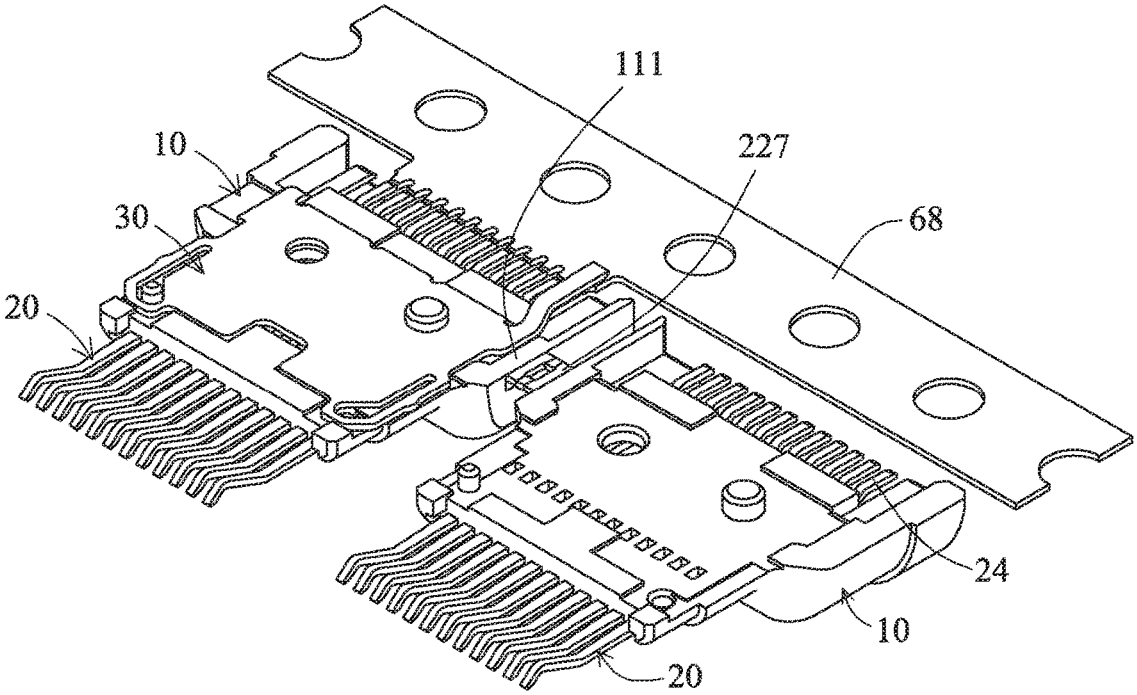
FIG. 57 is a pictorial view showing the manufacturing process according to the fifth embodiment of the invention.

Referring to FIG. 57, the metal partition plate 30 is placed on the inner surface of one insulation seat 10.

Figure 58:
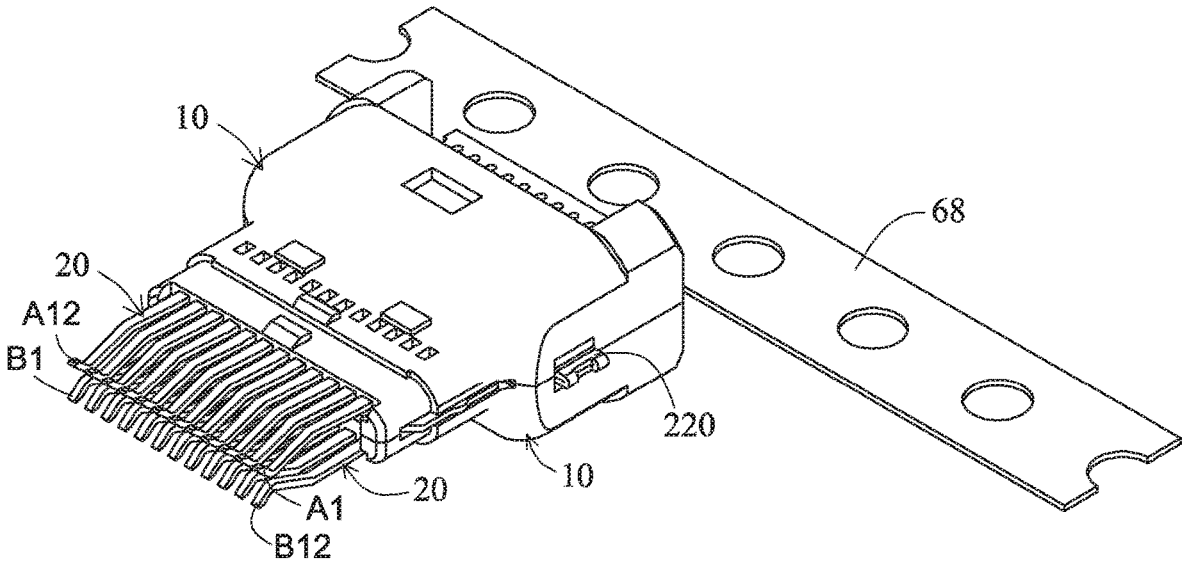
FIG. 58 is a pictorial view showing the manufacturing process according to the fifth embodiment of the invention.

Referring to FIG. 58, the upper insulation seat 10 is flipped by 180 degrees and stacked over the lower insulation seat 10. At this time, two rows of terminals 20 having the connection points with the same circuit serial numbers are arranged reversely in order.

Figure 60:
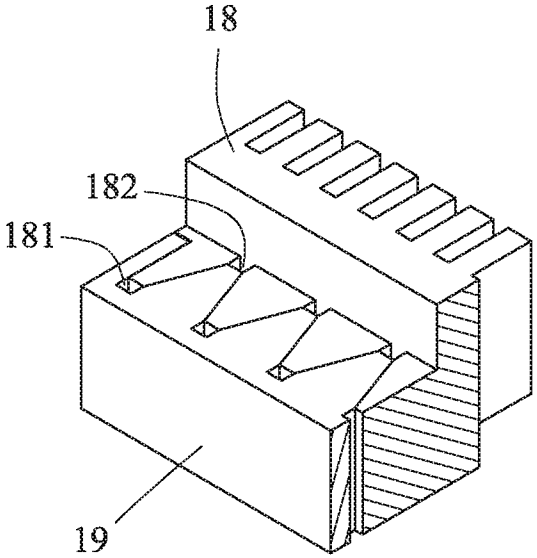
FIG. 60 is a pictorially cross-sectional view showing the rear cover according to the sixth embodiment of the invention.
Figure 59:
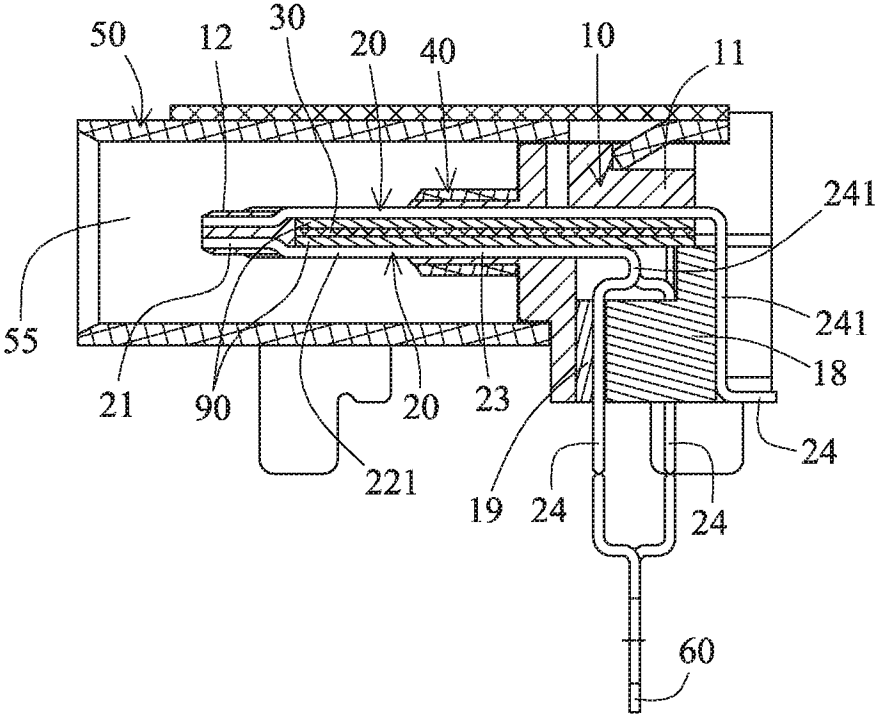
FIG. 59 is a cross-sectional side view showing the sixth embodiment of the invention.

Referring to FIGS. 59 and 60, the sixth embodiment of this invention provides a bidirectional duplex USB TYPE-C 3.0 electrical receptacle, which is provided with an insulation seat 10, two rows of terminals 20, a metal partition plate 30, a ground member 40, two insulation layers 90 and a metal housing 50.

The insulation seat 10 is provided with a base portion 11 and a docking portion, and the docking portion is in the form of a tongue 12.

The two insulation layers 70 are stacked over the top and bottom surfaces of the metal partition plate 30, and then the two rows of terminals 20 are stacked over the two insulation layers 70. The vertically stacked two rows of terminals, two insulation layers 70 and one metal partition plate 30 are integrally embedded into and fixed to the insulation seat 10 by way of injection molding, and extend from the base portion 11 to the tongue 12.

Each of the rows of terminals 20 have 12 terminals Each terminal 20 is integrally provided with a front end portion 21, a contact 221, a fixing portion 23, a rear extension 25 and a pin 24 from front to rear. The contact 221 is in flat surface contact with the docking portion 12, is elastically non-movable and exposed to the outside. The pin 24 extends out of the base portion 11. The fixing portion 23 is disposed between the pin 24 and the contact 21. The front end portion 21 and the contact 21 are provided with a bent step and are embedded into the tongue 12. The front end portions 21 of the two rows of terminals 20 are vertically aligned and have a height gap. The front end of the front end portion 21 is an electroplate-layer-free section 25. The contacts 21 of the two rows of terminals 20 are respectively exposed from two connection surfaces of the tongue 12 and are vertically aligned. The contacts of the two rows of terminals are arranged according to the circuit serial number of the connection point and are arranged in an equally spaced manner.

The metal housing 50 covers the insulation seat 10. The metal housing 50 is provided with a four-sided main housing. The four-sided main housing and the front end of the base portion 11 form a connection slot 55. The tongue 12 are horizontally suspended at the center height of the connection slot 55 and extends frontwards. The connection slot 55 and the tongue 12 form a docking structure for an electrical connection plug to be reversible and dual-positionally inserted for electrically connection and positioning.

The ground member 40 is disposed on the rear section of the tongue 12.

The distal sections of the pins of the upper row of terminals 24 are in one row of horizontal pins. The distal sections of the pins of the lower row of terminals 24 are in the form of two rows of vertical pins staggered in the front-left direction. The front sections 241 of the pins of the lower row of terminals extend out of the base portion 11, are then flush with each other in the front-rear direction, rest against the insulating layer 70, and then bent downwardly in an equally spaced bent manner in one front an one rear rows, so that the rear sections 241 of the pins are in the form of two rows of vertical pins staggered in the front-left direction.

Thus, the lower row of terminals 20 have the same material pulling length, so that the pins can be connected to the same material tape 60.

A two-piece rear cover structure provided with first and second rear covers 18 and 19 fitting with each other is additionally provided. The first and second rear covers 18 and 19 are provided with serrated joint structures and are in the form of front and rear rows of holes 181 and 182, so that the two rows of vertical pins of the lower row of terminals can pass therethrough.

The specific embodiments set forth in the detailed description of the preferred embodiments are merely illustrative of the technical details of the invention, and are not intended to limit the scope of the invention to the embodiments. Various modifications can be made without departing from the spirit of the invention and the following claims.

What is claimed is:

1. A bidirectional duplex electrical connector, comprising:

two insulation seats, wherein each of the insulation seats is integrally provided with a base portion and a docking portion, the docking portion is connected to a front end of the base portion, the docking portion is provided with a baseplate and two side plates, multiple inner surfaces of the base portions of the two insulation seats are provided with multiple resting surfaces mutually resting against each other and being vertically stacked, a connection slot is formed between the baseplates of the docking portions of the two insulation seats, the two side plates of the docking portions of the two insulation seats mutually rest against each other to form a fitting frame body, each of inner surfaces of the two insulation seats is provided with one row of front-to-rear extending terminal slots;

two rows of terminals, wherein the two rows of terminals are assembled into the two rows of terminal slots of the two insulation seats in a vertical direction, the terminal is integrally provided with, from front to rear, an elastically movable portion, a fixing portion and a pin, a front section of the elastically movable portion corresponds to the docking portion and is curved and provided with a contact projecting in the vertical direction, the elastically movable portion is elastically movable up and down, a rear section of the elastically movable portion and the fixing portion are on the same level and rest against a bottom surface of the terminal slot, the insulation seat is provided with a fixing structure fixing the fixing portions of the two rows of terminals, the rear sections of the elastically movable portions of the two rows of terminals still can rest against the bottom surfaces of the terminal slots to perform vertical elastic movement, the pin extends to a rear end of the base portion and is exposed, and the contacts of the two rows of terminals having connection points with the same circuit are arranged reversely; and a metal housing, which covers the two insulation seats and is provided with a four-sided main housing, wherein the four-sided main housing covers the docking portions of the two insulation seats to form a docking structure, and the docking structure can be positioned with a docking electrical connector in a dual-positional and bidirectional manner, wherein when the elastically movable portion of each of the two rows of terminals is forced to move elastically, the rear section of the elastically movable portion pertaining to the elastically movable portion, which is elastically movable up and down, is formed with a middle-section fulcrum supported by the bottom surface of the terminal slot, so that the rear section of the elastically movable portion exclusive of the middle-section fulcrum still can be partially separated from the bottom surface of the terminal slot and is curved to move elastically to form a gap between the bottom surface of the terminal slot of the base portion and the rear section of the elastically movable portion.

2. The bidirectional duplex electrical connector according to claim 1, wherein the fixing structure of the insulation seat is formed by way of secondary processing after the one row of terminals have been assembled.

3. The bidirectional duplex electrical connector according to claim 1, wherein a connection material bridge is provided between the two insulation seats and mutually connects the two insulation seats to each other, so that the two insulation seats are one-time plastic injection molded.

4. The bidirectional duplex electrical connector according to claim 3, satisfying one of (a) and (b):

(a) wherein the connection material bridge is a plastic material bridge, and the plastic material bridge and the two insulation seats are integrally formed by way of plastic injection molding; and (b) wherein the connection material bridge is a metal material bridge, and the metal material bridge is integrally connected to one pair of adjacent terminals of the two rows of terminals having the same circuit.

5. The bidirectional duplex electrical connector according to claim 1, wherein two outer sides of each of the two rows of terminals are provided with one pair of ground terminals arranged in a left-right symmetrical manner, a middle of each of the two rows of terminals is provided with one pair of power terminals arranged in the left-right symmetrical manner, the contacts of the two pairs of ground terminals of the two rows of terminals are vertically aligned, the contacts of the two pairs of power terminals of the two rows of terminals are vertically aligned, the one pair of ground terminals of at least one row of terminals of the two rows of terminals are integrally connected to a large U-shaped connection sheet, the one pair of power terminals of at least one row of terminals of the two rows of terminals are integrally connected to a small U-shaped connection sheet, the large U-shaped connection sheet is disposed outside the small U-shaped connection sheet so that a form of a large U shape covering a small U shape is formed, the two ground terminals having the two vertically aligned contacts have the two pins adjacently arranged, and the two power terminals having the two vertically aligned contacts have the two pins adjacently arranged, so that a number of bonding wires of the pins can be decreased.

6. The bidirectional duplex electrical connector according to claim 5, wherein each of the large and small U-shaped connection sheets extends backwards and bypasses a middle one of the pins of the terminals; or each of the large and small U-shaped connection sheets extends backwards and bypasses a middle one of the pins of the terminals, a height difference is present between the large U-shaped connection sheet in the one row of terminals and the horizontal pins of the row of terminals, and a height difference is present between the small U-shaped connection sheet in the one row of terminals and the horizontal pins of the row of terminals.

7. The bidirectional duplex electrical connector according to claim 1 satisfying one of (a) to (c):

(a) wherein the fixing structure is formed by encapsulant;

(b) wherein the fixing structure is formed by way of hot melting; and (c) wherein the fixing structure is a slot structure, and when the terminal is placed into the terminal slot in the vertical direction and then shifted in a front-rear direction, the fixing portion of the terminal can be locked with the slot structure.

8. The bidirectional duplex electrical connector according to claim 1, wherein a metal partition plate is provided between the two insulation seats, and two sides of the metal partition plate are integrally connected to and provided with two elastically movable snaps stretching into two sides of the connection slot.

9. The bidirectional duplex electrical connector according to claim 1, wherein at least one ground member is provided between the two insulation seats and the metal housing, a front section of the baseplate is provided with a low surface and a rear section of the baseplate is provided with a high surface, and the ground member is connected to at least one elastic sheet projecting beyond the low surface and stretching into the connection slot.

10. A bidirectional duplex electrical connector, comprising:

two insulation seats, wherein each of the insulation seats is integrally provided with a base portion and a docking portion, the docking portion is connected to a front end of the base portion, the docking portion is provided with a baseplate and two side plates, multiple inner surfaces of the base portions of the two insulation seats are provided with multiple resting surfaces mutually resting against each other and being vertically stacked, a connection slot is formed between the baseplates of the docking portions of the two insulation seats, and the two side plates of the docking portions of the two insulation seats mutually rest against each other to form a fitting frame body;

two rows of terminals fixedly disposed on the two insulation seats, wherein the terminal is integrally provided with, from front to rear, an elastically movable portion, a fixing portion and a pin, a front section of the elastically movable portion corresponds to the docking portion and is curved and provided with a contact projecting in the vertical direction, the elastically movable portion is elastically movable up and down, the fixing portion is fixed to the base portion of the insulation seat, the pin extends to a rear end of the base portion and is exposed, and the contacts of the two rows of terminals having connection points with the same circuit are arranged reversely; and a metal housing, which covers the two insulation seats and is provided with a four-sided main housing, wherein the four-sided main housing covers the docking portions of the two insulation seats to form a docking structure, and the docking structure can be positioned with a docking electrical connector in a dual-positional and bidirectional manner;

characterized in that each of multiple inner surfaces of the two insulation seats is provided with one row of separation columns performing separation to form one row of front-to-rear extending terminal slots, the terminals can be placed into the terminal slots in a vertical direction, two outer sides of each of the two rows of terminals are provided with one pair of ground terminals arranged in a left-right symmetrical manner, a middle of each of the two rows of terminals is provided with one pair of power terminals arranged in the left-right symmetrical manner, the contacts of the two pairs of ground terminals of the two rows of terminals are vertically aligned, the contacts of the two pairs of power terminals of the two rows of terminals are vertically aligned, the one pair of ground terminals of at least one row of terminals of the two rows of terminals are integrally connected to a large U-shaped connection sheet, the one pair of power terminals of at least one row of terminals of the two rows of terminals are integrally connected to a small U-shaped connection sheet, the large U-shaped connection sheet is disposed outside the small U-shaped connection sheet so that a form of a large U shape covering a small U shape is formed, the two ground terminals having the two vertically aligned contacts have the two pins adjacently arranged, and the two power terminals having the two vertically aligned contacts have the two pins adjacently arranged, so that a number of bonding wires of the pins can be decreased.

11. The bidirectional duplex electrical connector according to claim 10, wherein a connection material bridge is provided between the two insulation seats and mutually connects the two insulation seats to each other, so that the two insulation seats are one-time plastic injection molded.

12. The bidirectional duplex electrical connector according to claim 11, satisfying one of (a) and (b):

(a) wherein the connection material bridge is a plastic material bridge, and the plastic material bridge and the two insulation seats are integrally formed by way of plastic injection molding; and (b) wherein the connection material bridge is a metal material bridge, and the metal material bridge is integrally connected to one pair of adjacent terminals of the two rows of terminals having the same circuit.

13. The bidirectional duplex electrical connector according to claim 10, wherein a height difference is present between the U-shaped connection sheet in the one row of terminals and the horizontal pins of the row of terminals.

14. The bidirectional duplex electrical connector according to claim 10, wherein a metal partition plate is provided between the two insulation seats, and two sides of the metal partition plate are integrally connected to and provided with two elastically movable snaps stretching into two sides of the connection slot.

15. The bidirectional duplex electrical connector according to claim 10, wherein at least one ground member is provided between the two insulation seats and the metal housing, a front section of the baseplate is provided with a low surface and a rear section of the baseplate is provided with a high surface, and the ground member is connected to at least one elastic sheet projecting beyond the low surface and stretching into the connection slot.

16. The bidirectional duplex electrical connector according to claim 10, wherein each of the large and small U-shaped connection sheets extends backwards and bypasses a middle one of the pins of the terminals; or each of the large and small U-shaped connection sheets extends backwards and bypasses a middle one of the pins of the terminals, a height difference is present between the large U-shaped connection sheet in the one row of terminals and the horizontal pins of the row of terminals, and a height difference is present between the small U-shaped connection sheet in the one row of terminals and the horizontal pins of the row of terminals.

* * * * *